US007955770B2

(12) United States Patent
Miyakawa et al.

(10) Patent No.: US 7,955,770 B2
(45) Date of Patent: Jun. 7, 2011

(54) PHOTOCONDUCTOR, PHOTOCONDUCTOR CARTRIDGE AND IMAGE-FORMING APPARATUS

(75) Inventors: Nobuhiro Miyakawa, Ashiya (JP); Shinji Yasukawa, Shiojiri (JP); Tomotake Hiraga, Shiojiri (JP); Ken Ikuma, Suwa-shi (JP)

(73) Assignee: Seiko Epson Corporation, Tokyo (JP)

( * ) Notice: Subject to any disclaimer, the term of this patent is extended or adjusted under 35 U.S.C. 154(b) by 843 days.

(21) Appl. No.: 11/873,353

(22) Filed: Oct. 16, 2007

(65) Prior Publication Data

US 2008/0220354 A1 Sep. 11, 2008

(30) Foreign Application Priority Data

Oct. 25, 2006 (JP) ..... 2006-289693
Oct. 31, 2006 (JP) ..... 2006-295114
Nov. 2, 2006 (JP) ..... 2006-299007
Jun. 20, 2007 (JP) ..... 2007-162205

(51) Int. Cl.
*G03G 5/147* (2006.01)

(52) U.S. Cl. ..... 430/66; 430/96

(58) Field of Classification Search ..... 430/66, 430/96

See application file for complete search history.

(56) References Cited

U.S. PATENT DOCUMENTS 7,315,722 B2 * 1/2008 Kitajima et al. ..... 399/353
7,507,509 B2 * 3/2009 Nagai et al. ..... 430/58.7
2005/0158644 A1 * 7/2005 Kondo et al. ..... 430/108.1
2006/0134540 A1 * 6/2006 Kondo et al. ..... 430/59.5

FOREIGN PATENT DOCUMENTS

JP 02176666 * 7/1990
JP 05-040357 2/1993
JP 05-119502 5/1993
JP 10-288872 10/1998
JP 2000-267447 9/2000
JP 2001-013703 1/2001
JP 2001-066815 3/2001
JP 2002-278121 9/2002
JP 2002-351155 12/2002

OTHER PUBLICATIONS

Abstract of JP 02176666 Jul. 9, 1990.*

* cited by examiner

*Primary Examiner* — Hoa V Le
(74) *Attorney, Agent, or Firm* — DLA Piper LLP (US)

(57) ABSTRACT

The surface of a photoconductor is coated with a surface protection layer comprising a cured material of a fluorine-containing photo-curing composition containing fluorinated alkyl group-containing (meth)acrylate and a photopolymerization initiator, and the surface protection layer has a fluorine atom content of 8.5 to 20% by mass.

19 Claims, 5 Drawing Sheets

(A)

(B)

PHOTOCONDUCTOR, PHOTOCONDUCTOR CARTRIDGE AND IMAGE-FORMING APPARATUS

CROSS REFERENCE TO RELATED APPLICATIONS

This application is based upon and claims the benefit of priority from prior Japanese Patent Application No. 2006-289693, filed Oct. 25, 2006, prior Japanese Patent Application No. 2006-295114, filed Oct. 31, 2006, and prior Japanese Patent Application No. 2006-299007, filed Nov. 2, 2006, the entire contents of which, inclusive of the descriptions, drawings and abstracts, are incorporated herein by reference.

BACKGROUND OF THE INVENTION

1. Field of the Invention

The present invention relates to a photoconductor used for electrophotographs, electrostatic recording, electrostatic printing and the like, a photoconductor cartridge in which the photoconductor is incorporated, and an image-forming apparatus in which the photoconductor is incorporated.

2. Description of the Related Art

An electrophotographic method using a liquid developing agent has advantages of realizing a high resolution image quality by using a fine toner of sub-micron size, acquiring a sufficient image density with a small amount of toner, and the like. These advantages cannot be realized by an electrographic method using powder toner.

The photoconductor of an image-forming apparatus using a liquid developing agent has a structure in which a photoconductive layer is formed on a conductive substrate. The photoconductive layer is formed from organic materials, inorganic materials or amorphous silicon (a-Si) materials. The photoconductive layer formed from an a-Si material has a high hardness and therefore the photoconductor having the photoconductive layer (a-Si photoconductor) has a high wear resistance. However, when developing is performed using an a-Si photoconductor under a high humidity condition, there occur image deletions. Thus, in order to improve the hydrophobicity of an a-Si photoconductor to prevent image deletions, there was discussed a coating of the surface of a photoconductive layer formed from an a-Si material with a surface protection layer comprising fluorine-containing amorphous silicon carbide or fluorine-containing amorphous carbon, the coating described, for example, in Patent Document 1 (JP-A-2001-13703). There was also discussed a coating of the surface of a photoconductive layer formed from an a-Si material with a surface protection layer containing a thermosetting fluorine-containing polyimide as a major ingredient, the coating described, for example, in Patent Document 2 (JP-A-5-119502). When dry developing is performed using the a-Si photoconductor on which a surface protection layer is provided, discharge products adhere to the surface protection layer to cause image deletions. When wet developing is performed using the a-Si photoconductor on which a surface protection layer is provided, a liquid developing agent adheres to an undeveloped area of the surface protection layer, leading to photographic fog.

In order to prevent a liquid developing agent from adhering to the undeveloped area of the photoconductor, there was discussed a coating of the surface of an a-Si photoconductor with a release layer comprising an amorphous fluorine resin, the coating described, for example, in Patent Document 3 (JP-A-2002-278121). The release layer has a thickness of less than or equal to 10 nm, and therefore, as printing by means of an image-forming apparatus in which the photoconductor is mounted proceeds, oil repellency coming from an amorphous fluorine resin ceases to be exerted, thereby reducing the contact angle of a liquid developing agent on the photoconductor. That is, it is difficult to maintain the function of the photoconductor for a long time.

On the other hand, the hardness of a photoconductive layer formed from an organic material and a photoconductive layer formed from an in organic material is low, and therefore, the wear resistance of photoconductors having these photoconductive layers is not high. The photoconductor (organic photoconductor) having a photoconductive layer formed from an organic material has such a short lifetime as several to six months and the extension of the lifetime of an organic photoconductor is a problem to be solved. Further, there are also problems that carrier liquid adheres to the non-image area of the organic photoconductor, thereby causing scumming and image deletions or that the amount of cleaning toner is not reduced, making the control of the concentration of a liquid developing agent difficult. These problems are also to be solved.

Therefore, there was discussed a combination of an organic photoconductor on which a surface protection layer containing a fluorine resin is formed with a wet developing agent using isoper, silicon oil or the like as a carrier liquid, the combination described, for example, in Patent Document 4 (JP-A-5-40357) and in Patent Document 5 (JP-A-2002-278121). Further, there were also discussed an organic photoconductor having a contact angle ($\theta$) of a solvent such as isoper or the like to the surface protection layer of $20° < \theta < 110°$, having a good toner transferability and causing no image deletions, the photoconductor described, for example, in Patent Document 6 (JP-A-2000-267447) and an organic photoconductor having a contact angle ($\theta$) to a surface protection layer containing a fluorine resin of more than or equal to 30° and having high transferability and cleanability, the photoconductor described, for example, in Patent Document 7 (JP-A-2002-351155). There was also discussed an organic photoconductor on which a surface protection layer containing fluorinated organopolysiloxane, the photoconductor described, for example, in Patent Document 8 (JP-A-10-288872). The organic photoconductor on the surface of which a solution containing a resin dissolved in a solvent is applied and a resin-containing surface protection layer is formed has a low coating strength, and as is clear from the comparative examples described later, when a cleaning test is repeated as a load test, there occurs a problem that the contact angle on the surface protection layer is reduced, resulting in a lowered water- and oil-repellency performance. Further, the use of a perfluoro solvent applied on the fluorine resin is regulated in view of global warming.

SUMMARY OF THE INVENTION

It is an object of the present invention to provide a long-lived photoconductor having a good water- and oil-repellency performance, scratch resistance and anti-fouling property when vegetable oil is used as a carrier liquid for liquid developing. It is another object of the present invention to provide a photoconductor cartridge in which the photoconductor is incorporated and an image-forming apparatus in which the photoconductor is incorporated.

The present invention provides a photoconductor that is coated on the surface thereof with a surface protection layer comprising a cured material of a fluorine-containing photocuring composition containing fluorinated alkyl group-containing (meth)acrylate and a photopolymerization initiator, and the surface protection layer has a fluorine atom content of 8.5 to 20% by mass.

In a preferable embodiment of the present invention, the fluorinated alkyl group-containing (math)acrylate is represented by the following general formula (1):

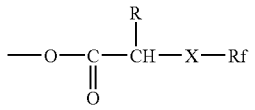

(1)

[wherein R is a hydrogen atom or an alkyl group having 1 to 4 carbon(s), and X is an alkylene chain that may have hetero atoms or a linkage group represented by the following general formula (2):

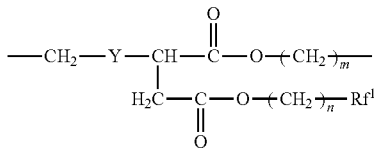

(2)

(wherein Y is an oxygen atom or a sulfur atom, m and n are integers of 1 to 4 that may be identical or different, and $Rf^1$ is a fluorinated alkyl group), and Rf is a fluorinated alkyl group.

In another preferable embodiment of the present invention, X in the general formula (1) is an alkylene group represented by the following general formula (3):

$$—(CH_2)_p—Z_q—(CH_2)_r— \quad (3)$$

[wherein Z is NR (R is a hydrogen atom or an alkyl group having 1 to 24 carbon(s)), an oxygen atom, a sulfur atom or NR—$SO_2$ (R is a hydrogen atom or an alkyl group having 1 to 24 carbon(s)), p is an integer of 0 to 4, q is 0 or 1, r is an integer of 0 to 20, and $1 \leqq p+r \leqq 20$.]

In a further preferable embodiment of the present invention, X in the general formula (1) is a linkage group represented by the general formula (2) [wherein $Rf^1$ is $C_nF_{2n+1}$ (n is an integer of 1 to 20)] or an alkylene chain represented by the general formula (3) [wherein Z is NR (R is a hydrogen atom or an alkyl group having 1 to 24 carbon(s)), an oxygen atom, a sulfur atom or NR—$SO_2$ (R is a hydrogen atom or an alkyl group having 1 to 24 carbon(s)), p is 1, q is 1, and r is an integer of 0 to 19], and further Rf in the general formula (1) is $C_nF_{2n+1}$ that is identical with or different from $Rf^1$ (n is an integer of 1 to 20).

In a still further preferable embodiment of the present invention, X in the general formula (1) is a linkage group represented by the general formula (2) [wherein Y is a sulfur atom and the carbon number of $Rf^1$ is 4, 6 or 8] or an alkylene chain represented by the general formula (3) [wherein Z is NR (R is a hydrogen atom or an alkyl group having 1 to 6 carbon(s)), a sulfur atom or NR—$SO_2$ (R is an alkyl group having 1 to 6 carbon(s)), and further the number of carbons n of Rf in the general formula (1) is 4, 6 or 8.

In a still further preferable embodiment of the present invention, the fluorinated alkyl-containing (meth)acrylate is a compound obtained by subjecting a compound (a1) having more than or equal to three (meth)acryloyl groups to a Michael-addition reaction with a compound represented by the following formula (4):

$$Rf—(CH_2)_r—Z—H \quad (4)$$

[wherein r is an integer of 0 to 20, and Rf is $C_nF_{2n+1}$ (n is an integer of 1 to 20), and Z is NR (R is a hydrogen atom or an alkyl group having 1 to 24 carbon(s)), an oxygen atom, a sulfur atom or NR—$SO_2$ (R is a hydrogen atom or an alkyl group having 1 to 24 carbon(s))], or a compound (a2) represented by the following general formula (5):

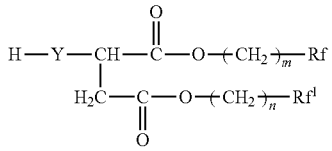

(5)

[wherein Y is an oxygen atom or a sulfur atom, m and n are integers of 1 to 4 that may be identical or different, and Rf and $Rf^1$ are $C_nF_{2n+1}$ (n is an integer of 1 to 20) that may be identical or different] at a ratio of 1 mol of the compound (a1) to 1.0 to (k-2) mol of the compound (a2) [wherein k is an average number of (meth)acryloyl groups in one molecule of the compound (a1)].

In a still further preferable embodiment of the present invention, the compound (a2) is a compound represented by the general formula (4) [wherein Z is NR (R is a hydrogen atom or an alkyl group having 1 to 6 carbon(s)), a sulfur atom or NR—$SO_2$ (R is an alkyl group having 1 to 6 carbon(s)), and the number of carbons n in Rf is 4, 6 or 8], or a compound represented by the general formula (5) [wherein Y is a sulfur atom and the respective numbers of carbons n in Rf and $Rf^1$ are 4, 6 or 8.]

In still another preferable embodiment of the present invention, the compound (a1) having more than or equal to three (meth)acryloyl groups is a compound (a1-1) represented by the following general formula (6):

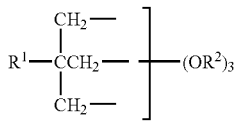

(6)

[wherein $R^1$ is a hydroxyl group, an alkyl group having 1 to 24 carbon(s), an alkylcarbonyloxy group having 1 to 24 carbon(s), $CH_2{=}CHCO_2CH_2$—, $CH_2{=}C(CH_3)CO_2CH_2$—, a (poly)oxyalkylene group having a number of cycles of more than or equal to 1 and closed at the terminal thereof by a hydrogen atom or an alkyl group having 1 to 18 carbon(s), or an alkylol group having 1 to 12 carbon(s), and $R^2$ is a (meth) acryloyl group], a compound (a1-2) represented by the following general formula (7):

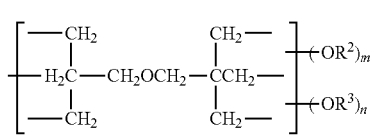

(7)

[wherein $R^2$ is a (meth)acryloyl group, $R^3$ is a hydrogen atom or an alkylcarbonyl group having 1 to 18 carbon(s), m is an integer of 3 to 6, n is an integer of 0 to 3, and further m+n=6], urethane (meth)acrylate (a1-3), cyanurate ring-containing tri (meth)acrylate (a1-4), or tri(meth)acrylate phosphate (a1-5).

In a still further preferable embodiment of the present invention, the compound (a1) having more than or equal to three (meth)acryloyl groups is a compound represented by the general formula (6) [wherein $R^1$ is a straight-chain alkyl group having 1 to 4 carbon(s), $CH_2{=}CHCO_2CH_2$—, $CH_2{=}C(CH_3)CO_2CH_2$—, or an alkylol group having 1 to 3 carbon(s)], a compound represented by the general formula (7) [wherein $R^3$ is a hydrogen atom or an alkylcarbonyl group having 1 to 12 carbon(s)] or urethane (meth)acrylate obtained by allowing hydroxyl group-containing (meth)acrylate having more than or equal to two (meth)acryloyl groups to react with isocyanate compounds having an alicyclic structure.

In still another preferable embodiment of the present invention, the contact angle of soybean oil on the surface protection layer of the photoconductor is 60° to 90°.

In a still further preferable embodiment of the present invention, the photoconductor is used for a liquid developing system.

In a still further preferable embodiment of the present invention, the photoconductor is an amorphous silicon photoconductor.

In still another preferable embodiment of the present invention, the surface protection layer of the amorphous silicon photoconductor has a thickness of 0.2 to 1.5 μm.

In a still further preferable embodiment of the present invention, the photoconductor is an organic photoconductor.

In still another preferable embodiment of the present invention, the binder of the organic photoconductive layer of the organic photoconductor is a polycarbonate resin and positively chargeable.

In a still further preferable embodiment of the present invention, the surface protection layer of the organic photoconductor has a thickness of 0.1 to 3 μm.

In still another preferable embodiment of the present invention, the fluorine-containing photo-curing composition of the photoconductor contains fluorine resin fine particles.

The present invention provides a photoconductor cartridge incorporating the photoconductor.

The present invention provides an image-forming apparatus incorporating the photoconductor and a developing means that develops electrostatic latent images formed on the photoconductor by means of a positively chargeable liquid developing agent containing vegetable oil as a carrier liquid.

DETAILED DESCRIPTION OF THE PREFERRED EMBODIMENTS

Figure 1:
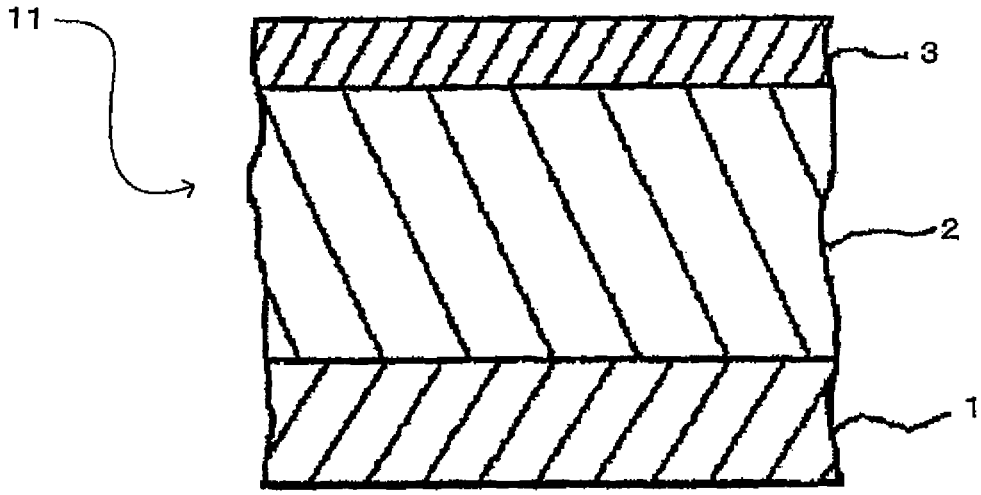
FIG. 1 is a sectional view showing the basic structure of a photoconductor.

FIG. 1 is a sectional view showing the basic structure of a photoconductor 11 of the present invention. A photoconductive layer 2 is formed on a conductive support 1 and a surface protection layer 3 is formed on the photoconductive layer 2.

Conductive Support

The conductive support 1 is shown in a cylindrical shape in FIG. 1, however, it may be sheet-like. There is used a conductive support obtained by applying a film of a conductive material such as a metal including aluminum, aluminum alloy, nickel, stainless steel, iron, brass or the like or such as a metallic oxide thereof on an isolating substrate such as polyester, polyimide, polycarbonate, glass or the like by means of evaporation coating or the like.

Organic Photoconductor

One of the illustrative examples of the photoconductive layer 2 is an organic photoconductive layer. The illustrative examples of the organic photoconductive layer include: a functional separation type laminated photoconductor in which a charge generating layer and a charge conveying layer are laminated sequentially; and a single layer type organic photoconductive layer. The single layer type organic photoconductive layer is obtained by coating the conductive support with a coating liquid comprising a charge generating agent, a charge conveying agent, a sensitizer, a binder and the like. The illustrative examples of the charge generating agents include: phthalocyanine pigments; azo pigments; quinone pigments; perylene pigments; quinocyatone pigments; indigo pigments; bisbenzoimidazole pigments; and quinacridone pigments. The charge generating agent includes preferably phthalocyanine pigments and azo pigments. The illustrative examples of the charge conveying agent include organic hole transport compounds such as hydrazone, stilbene, phenylamine, arylamine, diphenylbutadiene, oxazole and the like. The illustrative examples of the sensitizer include: paradiphequinone derivatives; naphthoquinone derivatives; and chloranil also known as electron conveying agents. The illustrative examples of the binder include: polycarbonate resins; polyarylate resins; and polyester resins, and include preferably polycarbonate resins.

The coating liquid has a composition ratio of 40 to 75% by mass of a binder, 0.5 to 20% by mass of a charge generating agent, 10 to 50% by mass of a charge conveying agent and 0.5 to 30% by mass of a sensitizer, and preferably a composition ratio of 45 to 65% by mass of a binder, 1 to 20% by mass of a charge generating agent, 20 to 40% by mass of a charge conveying agent and 2 to 25% by mass of a sensitizer. The respective ingredients are pulverized and dispersion-mixed with an organic solvent such as toluene, methylethylketone or the like in an agitator such as a homomixer, ball mill, sand mill, attritor, paint conditioner or the like to prepare a coating liquid. The coating liquid is applied on the conductive support by means of dip coating, ring coating, spray coating or the like and is then dried, thereby obtaining a dried film thickness of 15 to 40 μm and preferably of 20 to 35 μm.

a-Si Photoconductor

The illustrative examples of the materials composing the photoconductive layer of an a-Si photoconductor include: a-Si photoconductive materials or a-Si alloy photoconductive materials such as a-Si, amorphous silicon carbide (a-SiC), amorphous silicon nitride (a-SiN), amorphous silicon oxide (a-SiO), amorphous silicon germanium (a-SiGe), amorphous silicon carbide nitride (a-SiCN), amorphous silicon oxynitride (SiNO), amorphous silicon oxycarbide (a-SiCO), amorphous silicon carbo oxynitride (a-SiCNO) and the like. The illustrative examples of the film formation method using these photoconductive materials include: glow discharge decomposition method; spattering method; evaporation coating method; ECR method; optical CVD method; and a catalytic CVD method. In forming a film, 1 to 40 mol % of hydrogen (H), fluorine (F) and/or chlorine (Cl) is allowed to be contained in the film for a dangling-bond terminal.

A Group IIIa element of the periodic system (hereinafter abbreviated as a Group IIIa element), a Group Va element of the periodic system (hereinafter abbreviated as a Group Va element), elements such as carbon (C), nitrogen (N), oxygen (O) and the like are allowed to be contained in the film, thereby enabling characteristics such as electric characteristics (dark conductivity, photoconductivity and the like) and optical band gaps of the photoconductive layer to be adjusted. When allowing the elements such as C, N, O and the like to be contained in the film, the Group IIIa element has a content of 0.1 to 20,000 ppm, and the Group Va element has a content of 0.1 to 10,000 ppm. When allowing none or traces of the elements such as C, N, O and the like to be contained in the film, the Group IIIa element has a content of 0.01 to 200 ppm, and the Group Va element has a content of 0.01 to 100 ppm. The distribution of element concentrations of the Group IIIa element, the Group Va element, and the elements such as C, N, and the like may have a gradient in a layer thickness direction, and in this case, the average contents of such elements need only fall within the above-described range. The illustrative examples of the Group IIIa element and the Group Va element include preferably boron (B) and phosphorus (P) respectively. Boron and phosphorus have a good covalent binding ability, thereby enabling to make semiconducting properties more sensitive and to give a good optical sensitivity.

The a-Si photoconductive layer may contain microcrystal silicon (μc-Si). The contained μc-Si improves the dark conductivity and photoconductivity, increasing the freedom of design of the photoconductive layer. The a-Si photoconductive layer containing μc-Si is formed similarly by means of the above-described forming method under varied film formation conditions. For example, in the formation of the a-Si photoconductive layer containing μc-Si by means of a glow discharge decomposition method, substrate temperature and high-frequency electricity are set higher than in the formation of the a-Si photoconductive layer containing no μc-Si, and a higher flow rate of hydrogen as a dilution gas is obtained. Moreover, the above-described impurity elements can be added to the a-Si photoconductive layer containing μc-Si.

In order to obtain better electrophotographic characteristics, a carrier injection inhibiting layer may be formed between the a-Si photoconductive layer and the substrate or a surface layer may be formed on the surface of the photoconductive layer. The carrier injection inhibiting layer and the surface layer are formed from the above-described a-Si photoconductive material. The carrier injection inhibiting layer and the surface layer formed from the a-Si photoconductive material exhibit a good matching with the a-Si photoconductive layer and are formed continuously after the formation of the a-Si photoconductive layer by means of the coating equipment used for forming the a-Si photoconductive layer.

The carrier injection inhibiting layer formed from the a-Si photoconductive material contains the Group IIIa element and/or the Group Va element more than the photoconductive layer, thereby adjusting the conductivity type of the carrier injection inhibiting layer. The carrier injection inhibiting layer formed from the a-Si photoconductive material contains the elements such as C, N, O and the like more than the photoconductive layer, achieving a high resistance. The surface layer formed from the a-Si photoconductive material contains the elements such as C, N, O and the like more than the photoconductive layer, achieving a high resistance. The laminated carrier injection inhibiting layer and surface layer enhance charging ability, photoconductivity characteristic, durability, wear resistance and environment resistance, thereby enabling the good electrophotographic characteristics of the a-Si photoconductive layer further to be improved.

The a-Si photoconductive layer has a thickness of 5 to 100 μm and preferably of 15 to 80 μm. Moreover, the carrier injection inhibiting layer has a thickness of 0.1 to 10 μm and preferably of 0.3 to 5 μm. The surface layer has a thickness of 0.05 to 5 μm and preferably of 0.1 to 2 μm.

A surface protection layer 3 is provided on the photoconductive layer 2. The surface protection layer 3 comprises a cured material of a fluorine-containing photo-curing composition containing fluorinated alkyl group-containing (meth) acrylate and a photopolymerization initiator, and the surface protection layer 3 has a fluorine atom content of 8.5 to 20% by mass. The surface protection layer 3 has a high oil-repellency performance, scratch resistance and anti-fouling property against a liquid developing agent containing vegetable oil as a carrier liquid, thereby ensuring a high coating strength of the surface protection surface 3. Therefore, the photoconductor on which the surface protection layer 3 is formed has a long life.

Fluorine-containing Photo-Curing Composition

The fluorine-containing photo-curing composition used in the present invention is formed using the fluorine-containing photo-curing composition described in JP-A-2005-171238. Now, preferable embodiments will be described.

Fluorinated alkyl group-containing (meth)acrylate (A) has a functional group (A-1) having a fluorinated alkyl group represented by the general formulas (1) and (2), and more than or equal to two (meth)acryloyl groups (A-2), wherein A is (meth)acrylate having a fluorine atom content of equal to or more 25% by mass and a molecular weight of 500 to 4000.

X in the general formula (1) may be an alkylene chain represented by the following general formula (3):

$$—(CH_2)_p—Z_q—(CH_2)_r— \quad (3)$$

[wherein Z is NR (R is a hydrogen atom or an alkyl group having 1 to 24 carbon(s)), an oxygen atom, a sulfur atom or NR—$SO_2$ (R is a hydrogen atom or an alkyl group having 1 to 24 carbon(s)), p is an integer of 0 to 4, q is 0 or 1, r is an integer of 0 to 20, and $1 \leqq p+r \leqq 20$.]

X in the general formula (1) is a linkage group represented by the general formula (2) [wherein $Rf^1$ is $C_nF_{2n+1}$ (n is an integer of 1 to 20)] or an alkylene chain represented by the general formula (3) [wherein Z is NR (R is a hydrogen atom or an alkyl group having 1 to 24 carbon(s)), an oxygen atom, a sulfur atom or NR—$SO_2$ (R is a hydrogen atom or an alkyl group having 1 to 24 carbon(s)), p is 1, q is 1, and r is an integer of 0 to 19], and further Rf in the general formula (1) may be $C_nF_{2n+1}$ that is identical with or different from $Rf^1$ (n may be an integer of 1 to 20).

X in the general formula (1) is a linkage group represented by the general formula (2) [wherein Y is a sulfur atom and the carbon number n of $Rf^1$ is 4, 6 or 8] or an alkylene chain represented by the general formula (3) [wherein Z is NR (R is a hydrogen atom or an alkyl group having 1 to 6 carbon(s))], a sulfur atom or NR—$SO_2$ (R is an alkyl group having 1 to 6 carbon(s)), and further the number of carbons n of Rf in the general formula (1) may be 4, 6 or 8.

The fluorinated alkyl-containing (meth)acrylate may be a compound obtained by subjecting a compound (a1) having more than or equal to three (meth)acryloyl groups to a Michael-addition reaction with a compound represented by the following formula (4):

$$Rf—(CH_2)_r—Z—H \quad (4)$$

[wherein r is an integer of 0 to 20, and Rf is $C_nF_{2n+1}$ (n is an integer of 1 to 20), and Z is NR (R is a hydrogen atom or an alkyl group having 1 to 24 carbon(s)), an oxygen atom, a sulfur atom or NR—$SO_2$ (R is a hydrogen atom or an alkyl group having 1 to 24 carbon(s))], or a compound (a2) represented by the following general formula (5):

(5)

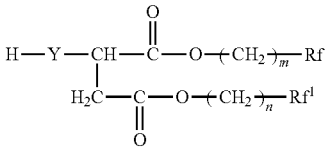

[wherein Y is an oxygen atom or a sulfur atom, m and n are integers of 1 to 4 that may be identical or different, and Rf and $Rf^1$ are $C_nF_{2n+1}$ (n is an integer of 1 to 20) that may be identical or different at a ratio of 1 mol of the compound (a1) to 1.0 to (k-2) mol of the compound (a2) (wherein k is an average number of (meth)acryloyl groups in one molecule of the compound (a1))].

The compound (a2) may be a compound represented by the general formula (4) [wherein Z is NR (R is a hydrogen atom or an alkyl group having 1 to 6 carbon(s)), a sulfur atom or NR—$SO_2$ (R is an alkyl group having 1 to 6 carbon(s)), and the number of carbons n in Rf is 4, 6 or 8], or a compound represented by the general formula (5) [wherein Y is a sulfur atom and the respective numbers of carbons n in Rf and $Rf^1$ are 4, 6 or 8.]

The compound (a1) having more than or equal to three (meth)acryloyl groups may be a compound (a1-1) represented by the following general formula (6):

(6)

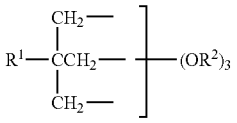

[wherein $R^1$ is a hydroxyl group, an alkyl group having 1 to 24 carbon(s), an alkylcarbonyloxy group having 1 to 24 carbon(s), $CH_2{=}CHCO_2CH_2$—, $CH_2{=}C(CH_3)CO_2CH_2$—, a (poly)oxyalkylene group having a number of cycles of more than or equal to 1 and closed at the terminal thereof by a hydrogen atom or an alkyl group having 1 to 18 carbon(s), or an alkylol group having 1 to 12 carbon(s), and $R^2$ is a (meth) acryloyl group], a compound (a1-2) represented by the following general formula (7):

(7)

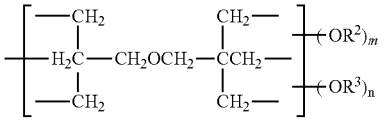

[wherein $R^2$ is a (meth)acryloyl group, $R^3$ is a hydrogen atom or an alkylcarbonyl group having 1 to 18 carbon(s), m is an integer of 3 to 6, n is an integer of 0 to 3, and further m+n=6], urethane (meth)acrylate (a1-3), cyanurate ring-containing tri (meth)acrylate (a1-4), or tri(meth)acrylate phosphate (a1-5).

The compound (a1) having more than or equal to three (meth)acryloyl groups may be a compound represented by the general formula (6) [wherein $R^1$ is a straight-chain alkyl group having 1 to 4 carbon(s), $CH_2{=}CHCO_2CH_2$—, $CH_2{=}C(CH_3)CO_2CH_2$—, or an alkylol group having 1 to 3 carbon(s)], a compound represented by the general formula (7) [wherein $R^3$ is a hydrogen atom or an alkylcarbonyl group having 1 to 12 carbon(s)] or urethane meth(acrylate) obtained by allowing hydroxyl group-containing (meth)acrylate having more than or equal to two (meth)acryloyl groups to react with an isocyanate compound having an alicyclic structure.

In the present invention, the (meth)acryloyl group is a generic name of an acryloyl group and a methacryloyl group. The fluorinated alkyl group is a generic name of a perfluoroalkyl group in which all hydrogen atoms in the alkyl group are substituted with fluorine atoms and groups (for example, $HCF_2CF_2CF_2CF_2$— and the like) in which a part of hydrogen atoms in the alkyl group is substituted with fluorine atoms. Groups (for example, $CF_3$—$OCF_2CF_2)_2$— and the like) containing oxygen atoms in the fluorinated alkyl group are also included in this definition.

Fluorinated alkyl group-containing (meth)acrylate (A) used in the present invention contains preferably a functional group (A-1) having a fluorinated alkyl group at a terminal represented by the general formulas (1) and (2).

The structure represented by the general formula (1) exhibits little deterioration due to hydrolysis and contributes to the long-term stability of the performance of the cured material because there exist alkylene chains or the like between the carbonyl carbons in an ester bond and the fluorinated alkyl group. The fluorinated alkyl group in the structure exists at the terminal of a molecule, is not taken in as a portion of the network in cross-linking and further has a —$CF_3$ group contributing largely to surface tension depressing ability. Thus, when using the compound represented by the general formula (1) as a coating material, fluorine atoms are advantageously arranged on the coating surface, thereby effectively exhibiting the surface characteristics coming from the fluorine atoms.

Fluorinated alkyl group-containing (meth)acrylate (A) used in the present invention has preferably more than or equal to two (meth)acryloyl groups (A-2). When there exist more than or equal to two cross-link points in one molecule at the time of curing reaction, a strong three-dimensional network structure is formed.

The fluorinated alkyl group-containing (meth)acrylate (A) used in the present invention has preferably a fluorine atom content in one molecule of more than or equal to 25% by mass. When the fluorinated alkyl group-containing (meth) acrylate (A) has a fluorine atom content in one molecule of less than 25% by mass, it is required to use an increased amount of the fluorinated alkyl group-containing (meth)acrylate (A) together with other reactive compounds and/or non-reactive compounds having a high fluorine atom content for exerting sufficient surface and optical characteristics. Thus, such a fluorine atom content is economically disadvantageous, a detailed mixing ratio having taken the compatibility of the respective ingredients sufficiently into consideration must be determined.

The fluorinated alkyl group-containing (meth)acrylate (A) used in the present invention has preferably a molecular weight of 500 to 4000. When (A) has a molecular weight of more than 4000, the cross-link density is reduced, leading to insufficient mechanical characteristics. When (A) has a molecular weight of less than 500, fluorine atoms are introduced only insufficiently.

By using fluorinated alkyl group-containing (meth)acrylate (A) satisfying the above-described conditions, there can be obtained a cured material having good surface and optical characteristics coming from fluorine atoms, containing a strong three-dimensional network structure with a high cross-link density and having high mechanical characteristics (mechanical strength) and hydrolysis resistance.

The fluorinated alkyl group-containing (meth)acrylate (A) has most preferably a fluorine atom content in one molecule of more than or equal to 30 to 65% by mass and most preferably a molecular weight of 600 to 3500.

When the functional group (A-1) and the more than or equal to two (meth)acryloyl groups (A-2) are bonded via an alkylene chain (A-3) that may have identical or different oxygen atoms and has 1 to 5 carbon atom(s) to quarternary carbons, a cyanurate ring or a phosphoryl group (A-4) respectively, and further, when at least one of the more than or equal to two (meth)acryloyl groups is bonded via the alkylene chain (A-3) to the quarternary carbons, cyanurate ring or phosphoryl group (A-4) to which the functional group (A-1) is bonded via the alkylene chain (A-3), thereby forming a three-dimensional network structure, quarternary carbons, a cyanurate ring or a phosphoryl group having a low degree of freedom are arranged in an area where cross-link points are connected with one another, leading to a stronger three-dimensional network structure and improved mechanical characteristics. Further, there arranged, in the vicinity of cross-link points, fluorinated alkyl groups, leading to improved optical characteristics of the cured material. Therefore, the preferable alkylene chain (A-3) is an alkylene chain having 1 to 3 carbon(s) or an oxyalkylene chain having 1 to 3 carbon(s).

In the view of the hydrolysis resistance of the cured material, X in the general formula (1) is an alkylene chain represented by the following general formula (3):

$$—(CH_2)_p—Z_q—(CH_2)_r— \quad (3)$$

[wherein Z is NR (R is a hydrogen atom or an alkyl group having 1 to 24 carbon(s)), an oxygen atom, a sulfur atom or NR—$SO_2$ (R is a hydrogen atom or an alkyl group having 1 to 24 carbon(s)), p is an integer of 0 to 4, q is 0 or 1, r is an integer of 0 to 20, and $1 \leqq p+r \leqq 20$.] Particularly, a compound in which X in the general formula (1) is an alkylene chain represented by the following general formula (3) [wherein Z is NR (R is a hydrogen atom or an alkyl group having 1 to 24 carbon(s)), an oxygen atom, a sulfur atom or NR—$SO_2$ (R is a hydrogen atom or an alkyl group having 1 to 24 carbon(s)), p is 1, q is 1, and r is an integer of 0 to 19], or a linkage group represented by the general formula (2) [wherein $Rf^1$ is —$C_nF_{2n+1}$ (n is an integer of 1 to 20.)], and in which Rf in the general formula (1) is —$C_nF_{2n+1}$ (n is an integer of 1 to 20) that is identical with or different from $Rf^1$ can be manufactured by means of a Michael-addition reaction described later. Thus, this compound is suitable for industrial production. When the fluorinated alkyl group is a perfluoroalkyl group, the performance coming from fluorine atoms is exerted effectively. When any other fluorinated alkyl group than the perfluoroalkyl group is used, the compatibility of the fluorinated alkyl group-containing (meth)acrylate with other ingredients mixed as needed and described later is improved, leading to improved flexibility and toughness and adhesion of the cured material. Therefore, the structures and kinds of fluorinate alkyl groups are selected according to required cured material performances.

When a compound is used, wherein Z in the general formula (3) is NR (R is a hydrogen atom or an alkyl group having 1 to 24 carbon(s)), a sulfur atom or NR—$SO_2$ (R is an alkyl group having 1 to 6 carbon(s)), or Y in the general formula (2) is a sulfur atom, the number of carbons n of $Rf^1$ is 4, 6 or 8, and the number of carbons n of Rf in the general formula (1) is 4, 6 or 8, there can be obtained a cured material having very good surface, optical and mechanical characteristics. R in the general formula (1) is preferably a hydrogen atom or a methyl group in a view of industrial availability of raw materials and manufacturability by means of a Michael-addition reaction.

The illustrative examples of the fluorinated alkyl group-containing (meth)acrylate used in the present invention include: compounds represented by the following general formulas (I) to (X):

(I)

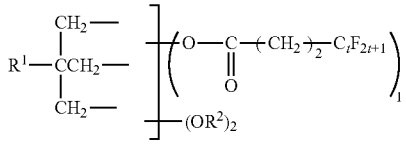

(II)

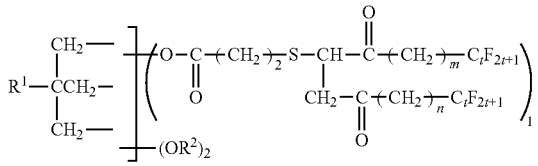

(III)

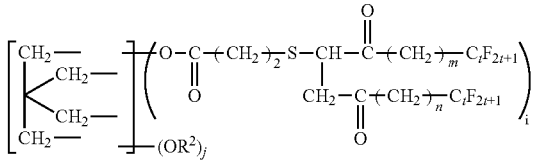

[wherein $R^1$ is a hydroxyl group, a straight-chain alkyl group having 1 to 4 carbon(s), $CH_2{=}CHCO_2CH_2$—, $CH_2{=}C(CH_3)CO_2CH_2$—, or an alkylol group having 1 to 3 carbon(s), $R^2$ is a (meth)acryloyl group, m and n are integers of 1 to 4 that may be identical or different, t is 4, 6 or 8, i is 1 or 2, j is 2 or 3, and further i+j=4.]

(IV)

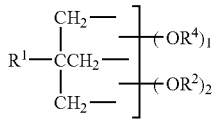

[wherein $R^1$ and $R^2$ are same as those in Formulas (I) to (III), and $R^4$ is a group in which $HS(CH_2)_2C_tF_{2t+1}$ or $HN(C_3H_7)(CH_2)_2C_tF_{2t+1}$ is Michael added to a (meth)acryloyl group (in this formula, t denotes 4, 6 or 8).]

(V)

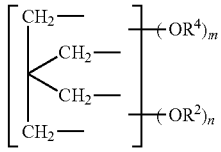

[wherein $R^2$ and $R^4$ are same as those in Formulas (I) to (IV), m is 1 or 2, n is 2 or 3, and m+n=4.]

(VI)

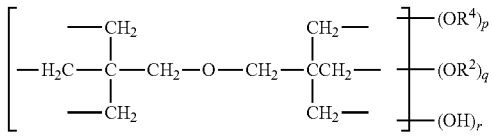

[wherein $R^2$ and $R^4$ are same as those in Formulas (I) to (IV), p is an integer of 1 to 4, q is an integer of 2 to 5, r is an integer of 0 to 3, and further p+q+r=6.]

(VII)

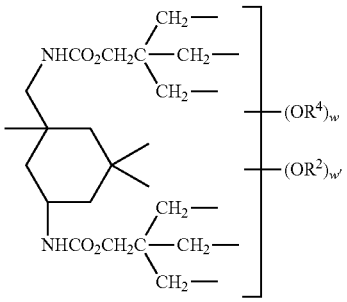

(VIII)

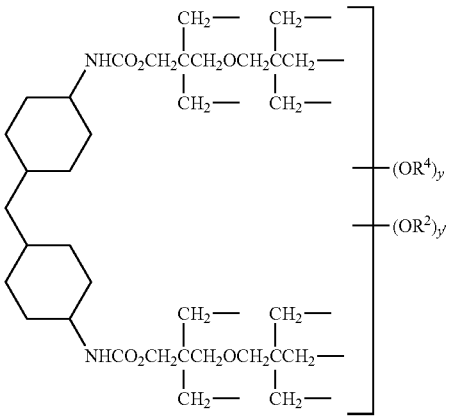

[wherein $R^2$ and $R^4$ are same as those in Formulas (I) to (IV), w is an integer of 1 to 4, w' is an integer of 2 to 5, and further w+w'=6; y is an integer of 1 to 8, y' is an integer of 2 to 9, and further y+y'=10.]

(IX)

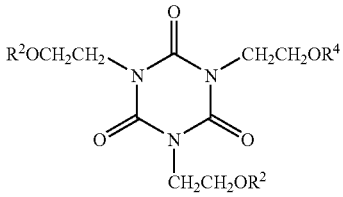

[wherein $R^2$ and $R^4$ are same as those in Formulas (I) to (IV).]

(X)

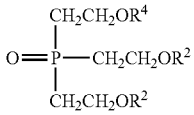

[wherein $R^2$ and $R^4$ are same as those in Formulas (I) to (IV).]

The illustrative examples of the fluorinated alkyl group-containing (meth)acrylate include the following compounds. Moreover, all the following illustrative examples are acrylates, and all the acryloyl groups in the formulas can be replaced with methacryloyl groups. Further, in the following illustrative examples, there is shown only one case where R in the general formula (1) is a hydrogen atom, and one of the hydrogen atoms in the methylene group bonded to carbonyl carbons can be replaced with a methyl group.

(i)

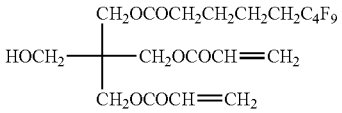

(ii)

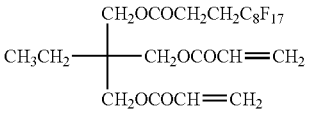

(iii)

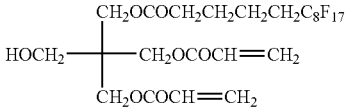

(iv)

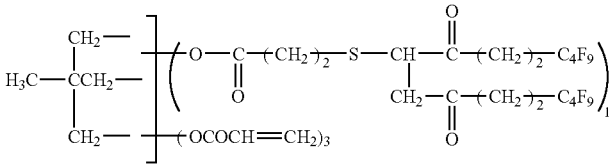

(v)

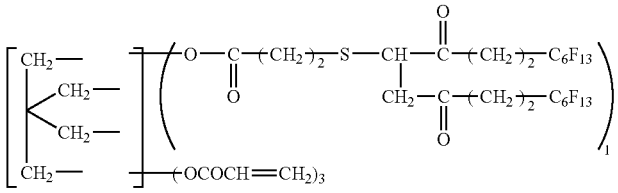

-continued
(vi)
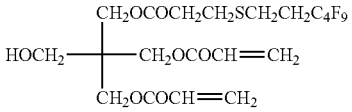
(vii)
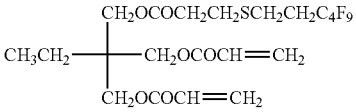
(viii)
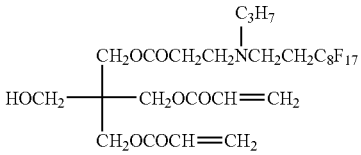
(ix)
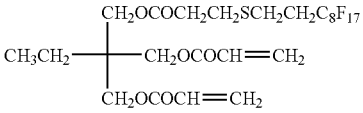
(x)
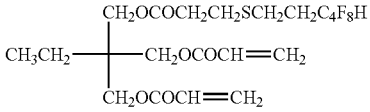
(xi)
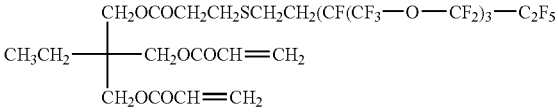
(xii)
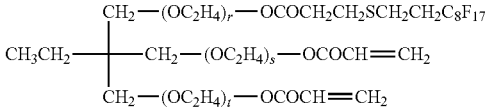
r + s + t = 3
(xiii)
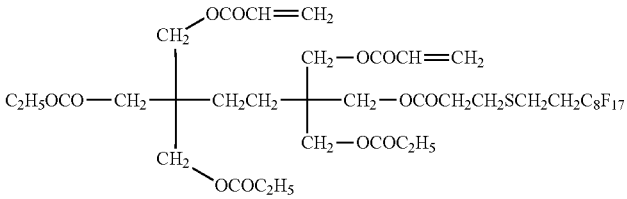
(xiv)
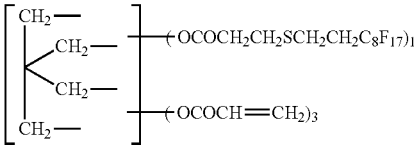
(xv)
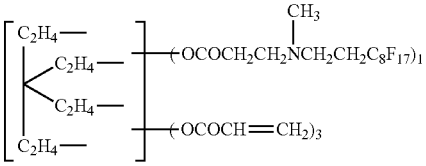
(xvi)
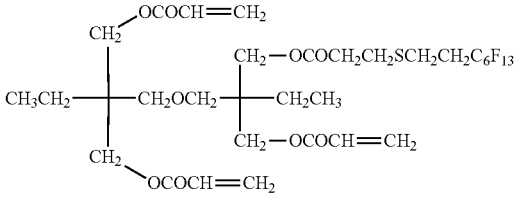
(xvii)
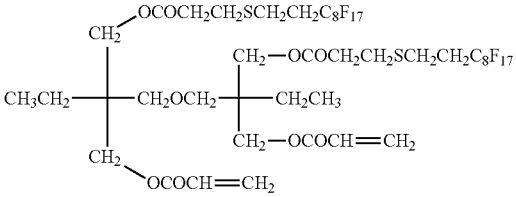
(xviii)
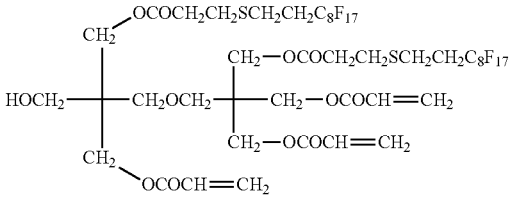
(xix)
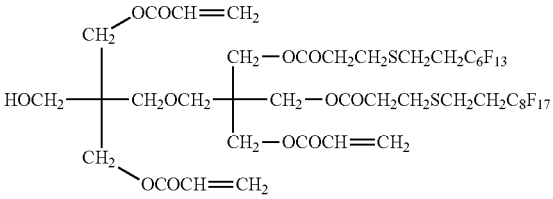
(xx)
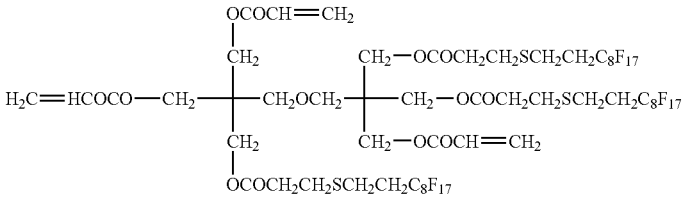

-continued
(xxi)
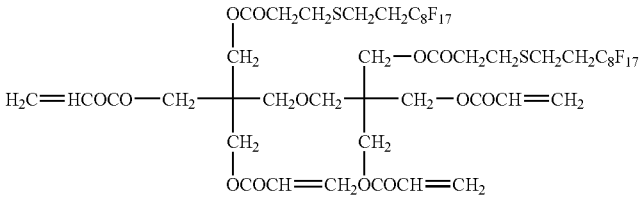
(xxii)
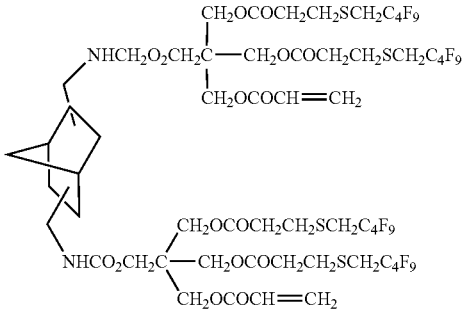
(xxiii)
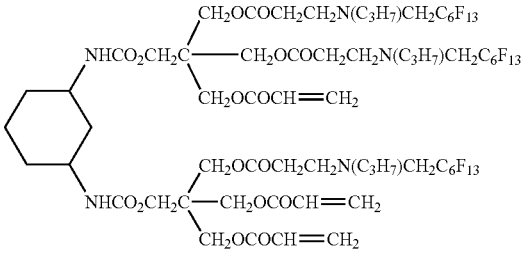
(xxiv)
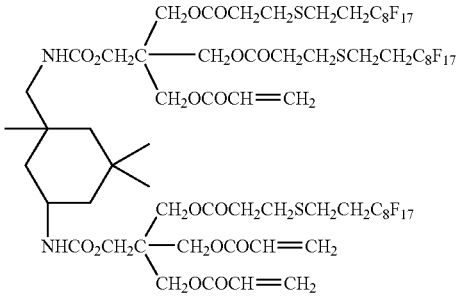
(xxv)
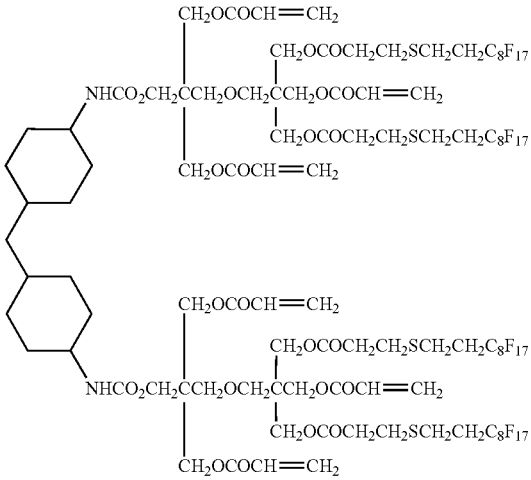
(xxvi)
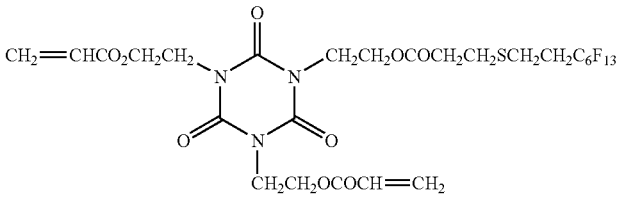

-continued (xxvii)

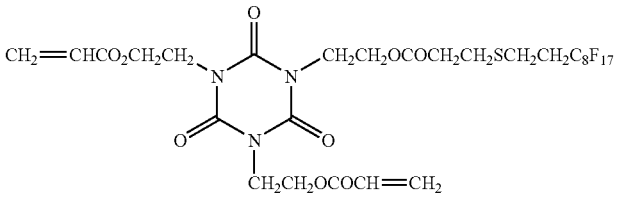

(xxviii)

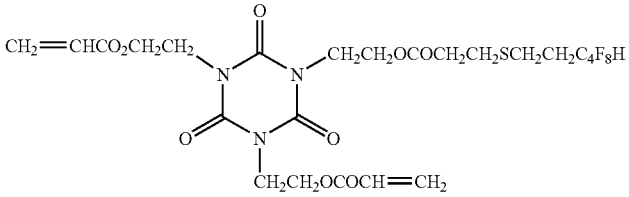

(xxix)

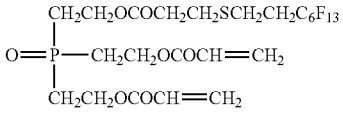

(xxx)

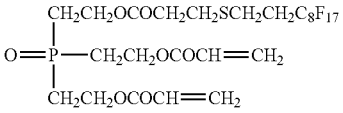

The method of manufacturing the fluorinated alkyl group-containing (meth)acrylate (A) is not limited to any particular one. The illustrative examples of the method of manufacturing the same include: a method of allowing a compound (a1) having more than or equal to three (meth)acryloyl groups to react with a compound having a fluorinated alkyl group and active hydrogen by means of Michael-addition reaction; and a method of adding a polymerization inhibitor such as hydroquinone to a raw material containing alkylcarboxylate having a fluorinated alkyl group, polyvalent alcohol and (meth) acrylate and subjecting the raw material to a reaction at 80 to 120° C. for 3 to 10 hours under the presence of an acid catalyst such as hydrochloric acid, sulfuric acid or the like with removing the water generated by means of a condensation reaction.

Particularly, producing no excessive compounds as by-products, proceeding under mild conditions as described later, and being capable of adjusting the fluorine atom content in the respective molecules and the number of the functional groups of the (meth)acryloyl group easily, the Michael-addition reaction is a preferable method for obtaining the fluorinated alkyl group-containing (meth)acrylate used for the fluorine-containing photo-curing composition of the present invention.

Now, a method of synthesizing the fluorinated alkyl group-containing (meth)acrylate by means of Michael-addition reaction will be described in detail.

The compound (a-1) having more than or equal to three (meth)acryloyl groups need only contain more than or equal to three (meth)acryloyl groups in the respective molecule, is not limited to any particular one and is selected arbitrarily. In view of the availability of raw materials and the rapid progress of the reaction under mild conditions, the compound (a-1) is preferably a compound (a1-1) represented by the following general formula (6):

(6)

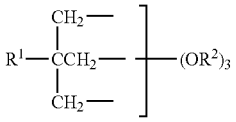

[wherein $R^1$ is a hydroxyl group, an alkyl group having 1 to 24 carbon(s), an alkylcarbonyloxy group having 1 to 24 carbon(s), $CH_2{=}CHCO_2CH_2{-}$, $CH_2{=}C(CH_3)CO_2CH_2{-}$, a (poly)oxyalkylene group having a number of cycles of more than or equal to 1 and closed at the terminal thereof by a hydrogen atom or an alkyl group having 1 to 18 carbon(s), or an alkylol group having 1 to 12 carbon(s), and $R^2$ is a (meth) acryloyl group], a compound (a1-2) represented by the following general formula (7):

(7)

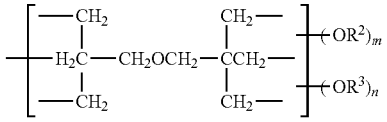

[wherein $R^2$ is a (meth)acryloyl group, $R^3$ is a hydrogen atom or an alkylcarbonyl group having 1 to 18 carbon(s), m is an integer of 3 to 6, n is an integer of 0 to 3, and further m+n=6], urethane (meth)acrylate (a1-3), cyanurate ring-containing tri (meth)acrylate (a1-4), or tri(meth)acrylate phosphate (a1-5).

Such compound is most preferably a compound represented by the general formula (6) [wherein $R^1$ is a straight-chain alkyl group having 1 to 4 carbon(s), $CH_2{=}CHCO_2CH_2{-}$, $CH_2{=}C(CH_3)CO_2CH_2{-}$, or an alkylol group having 1 to 3 carbon(s)], a compound represented by the general formula (7) [wherein $R^3$ is a hydrogen atom or an alkylcarbonyl group having 1 to 12 carbon(s)] or urethane (meth)acrylate obtained by allowing hydroxyl group-containing (meth)acrylate (×1) (having more than or equal to two (meth)acryloyl groups to react with isocyanate compounds (×2) having an alicyclic structure.

The illustrative examples of the compound (a1) having more than or equal to three (meth)acryloyl groups include the following compounds:

The illustrative examples of 3-functional (meth)acrylate include: ethylene oxide (EO)-modified glycerol acrylate (for example, NEW FRONTIER GE3A made by DAI-ICHI KOGYO SEIYAKU CO., LTD.); propylene oxide (PO)-modified glycerol triacrylate (for example, BEAM SET 720 made by ARAKAWA CHEMICAL INDUSTRIES LTD.); pentaerythritol triacrylate (PETA) (for example, NEW FRONTIER PET-3 made by DAI-ICHI KOGYO SEIYAKU CO., LTD.); trimethylolpropane triacrylate (TMTPA) (for example, NEW FRONTIER TMTP made by DAI-ICHI KOGYO SEIYAKU CO., LTD.); caprolactone-modified trimethylolpropane triacrylate (TMTPA) (for example, Ebecryl 2047 made by DAICEL-UCB CO., LTD.); hydroxypropylacrylate (HPA)-modified trimethylolpropane triacrylate (for example, KAYARAD THE-330 made by NIPPON KAYAKU CO., LTD.); (EO)- or (PO)-modified trimethylolpropane triacrylate (for example, LUMICURE ETA-300 made by DAINIPPON INK AND CHEMICALS INC. and NEW FRONTIER MP-3P made by DAI-ICHI KOGYO SEIYAKU CO., LTD.); alkyl-modified dipentaerythritol triacrylate (for example, KAYARAD D-330 made by NIPPON KAYAKU CO., LTD.); tris (acryloxyethyl) isocyanurate (for example, FANCRYL FA-731A made by HITACHI CHEMICAL CO., LTD); and EO-modified phosphoric acid triacrylate (for example, BISCOAT 3A made by OSAKA ORGANIC CHEMICAL INDUSTRY LTD.)

The illustrative examples of 4-functional (meth)acrylate include: ditrimethylolpropane tetraacrylate (DTMPTA) (for example, LUMICURE DTA-400 made by DAINIPPON INK AND CHEMICALS INC.); pentaerythritol ethoxytetraacrylate (for example, DIA-BEAM UK-4154 made by MITSUBISHI RAYON CO., LTD.); and pentaerythritol tetraacrylate (PETTA) (for example, NK-ESTER A-TMMT made by SHIN-NAKAMURA CHEMICAL CO., LTD.).

The illustrative examples of 5-functional or 6-functional (meth)acrylate include: dipentaerythritol hydroxypentaacrylate (for example, SR-399E made by KAYAKU-SARTOMER CO., LTD.): alkyl-modified dipentaerythritol pentaacrylate (for example, KAYARAD D-310 made by NIPPON KAYAKU CO., LTD.); dipentaerythritol hexaacrylate (for example, DAP-600 made by DAINIPPON INK AND CHEMICALS INC.); and dipentaerythritol pentaacrylate and hexaacrylate-based multifunctional monomer mixtures (for example, LUMICURE DPA-620 made by DAINIPPON INK AND CHEMICALS INC.).

The respective above-described (meth)acrylates may be used independently or in combination of a plurality of different compounds containing structures other than the above-described number of (meth)acryloyl groups. For the above-described commercially available compounds, there are mixed compounds having a different number of (meth)acryloyl groups with a specified compound as a main ingredient. In using these commercially available compounds there may be extracted compounds having a specified number of (meth) acryloyl groups by means of purifications methods such as various chromatography techniques, extraction and the like, and mixtures of such compounds may be used.

The compound (a1) used in the present invention may be urethane(meth)acrylate (a1-3). The method of manufacturing the urethane(meth)acrylate (a1-3) is not limited to any particular one at all. The illustrative example of the method of manufacturing the same includes a polyaddition reaction of hydroxyl group-containing (meth)acrylate (×1) having more than or equal to two (meth)acryloyl groups with isocyanate compounds. The reaction may be performed without using a catalyst, however, in view of reaction efficiency, there may be used a reaction auxiliary agent such as an urethanating catalyst or the like. The illustrative examples of the urethanating catalyst include: copper naphthenate; cobalt naphthenate; zinc naphthenate; dibutyltin dilaurate; triethylamine; 1,4-diazabicyclo[2.2.2]octane; 2,6,7-trimethyl-1,4-diazabicyclo[2.2.2]octane. The urethanating catalyst is used preferably at a ratio of 0.01 to 10% by mass to the total weight of the hydroxyl group-containing (meth)acrylate (×1) and isocyanate compounds (×2) used as raw materials.

The illustrative examples of the hydroxyl group-containing (meth)acrylate (×1) include: 2-hydroxyethyl (meth)acrylate; pentaerythritol triacrylate; dipentaerythritol hydroxypentaacrylate; and 2-hydroxy-3-acryloyloxypropyl (meth)acrylate (for example, BLEMMER-GAM made by NOF CORPORATION).

As isocyanate compounds, there may be used any of aromatic isocyanate compounds, aliphatic isocyanate compounds and alicyclic isocyanate compounds. The illustrative examples of the isocyanate compounds include: toluene diisocyanate; tolylene diisocyanate; norbornane diisocyanate; isophorone diisocyanate; hexamethylene diisocyanate; trimethyl hexamethylene diisocyanate; and adamantyl diisocyanate. In view of the glass transition temperature and scratch resistance of an obtained cured material, the preferable isocyanate compound is an isocyanate compound having an alicyclic structure. The illustrative examples of the isocyanate compound having an alicyclic structure include: norbornane diisocyanate; isophorone diisocyanate; and adamantyl diisocyanate. The preferable urethane (meth)acrylate (a1-3) is urethane (meth)arylate obtained by allowing hydroxyl group-containing (meth)acrylate (×1) having more than or equal to two (meth)acryloyl groups to react with isocyanate compounds (×2) having an alicyclic structure.

Now, compounds having a fluorinated alkyl group and active hydrogen will be described.

In view of the industrial availability of raw materials and the easiness of Michael-addition reaction, such compounds are preferably a compound represented by the following formula (4):

$$Rf—(CH_2)r—Z—H \quad (4)$$

[wherein r is an integer of 0 to 20, Rf is $C_nF_{2n+1}$ (n is an integer of 1 to 20), and Z is NR (R is a hydrogen atom or an alkyl group having 1 to 24 carbon(s)), an oxygen atom, a sulfur atom or NR—$SO_2$ (R is a hydrogen atom or an alkyl group having 1 to 24 carbon(s))], or a compound represented by the following general formula (5):

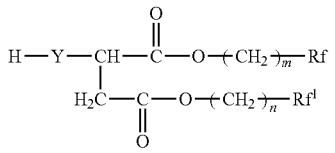

(5)

[wherein Y is an oxygen atom or a sulfur atom, m and n are integers of 1 to 4 that may be identical or different, and Rf and $Rf^1$ are $C_nF_{2n+1}$ (n is an integer of 1 to 20) that may be identical or different.] In view of milder reaction conditions and physicality of an obtained cured material, Z in the general formula (4) is a hydrogen atom, a nitrogen atom having an alkyl group having 1 to 6 carbon(s), a sulfur atom or NR—$SO_2$ (R is an alkyl group having 1 to 6 carbon(s)). The number of carbons n in Rf is preferably 4, 6 or 8, Y in the general formula (5) is preferably a sulfur atom, and the respective numbers of carbons n in Rf and $Rf^1$ are preferably 4, 6 or 8.

The fluorinated alkyl group-containing (meth)acrylate (A) manufactured by using fluorine-containing compounds represented by the general formula (4) or (5) is advantageous in view of compatibility with other ingredients used together as needed and also compatibility of transparency of an obtained cured material with surface and optical characteristics coming from fluorine atoms.

The illustrative examples of the fluorine-containing compounds represented by the general formula (4) include the following compounds: These compounds may be used independently or as a mixture of more than or equal to two types thereof.

| | |
|---|---|
| $C_4F_9SO_2N(CH_3)H$ | (a2-1) |
| $C_4F_9SO_2N(C_3H_7)H$ | (a2-2) |
| $C_4F_9CH_2CH_2N(C_8H_{17})H$ | (a2-3) |
| $C_4F_9CH_2CH_2SH$ | (a2-4) |
| $C_6F_{13}CH_2CH_2SO_2N(C_8H_{17})H$ | (a2-5) |
| $C_6F_{13}CH_2CH_2SH$ | (a2-6) |
| $C_6F_{13}CH_2CH_2N(C_4H_9)H$ | (a2-7) |
| $C_8F_{17}CH_2CH_2SH$ | (a2-8) |
| $C_8F_{17}CH_2N(C_3H_7)H$ | (a2-9) |
| $C_9F_{19}CH_2CH_2SH$ | (a2-10) |
| $C_{10}F_{21}CH_2CH_2CH_2N(C_3H_7)H$ | (a2-11) |
| $C_{12}F_{25}CH_2CH_2SH$ | (a2-12) |

The illustrative example of a method of manufacturing the fluorine-containing compounds represented by the general formula (5) includes a method of obtaining a diester body by allowing 2-hydroxysuccinic acid (hereinafter referred to as malic acid) or 2-mercaptosuccinic acid (hereinafter referred to as thiomalic acid) to react with fluorinated alkyl group-containing alcohol or fluorinated alkyl group-containing mercaptan. The illustrative examples of the fluorine-containing compounds represented by the general formula (5) include the following compounds:

(a2-13)

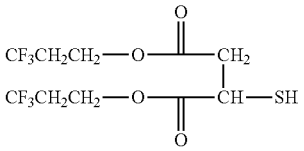

(a2-14)

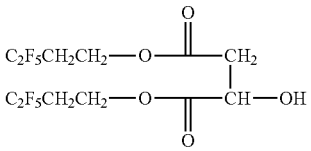

(a2-15)

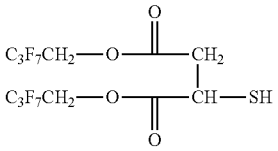

(a2-16)

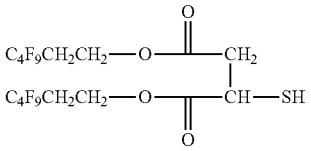

(a2-17)

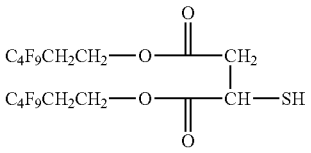

-continued (a2-18)

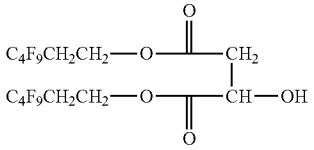

(a2-19)

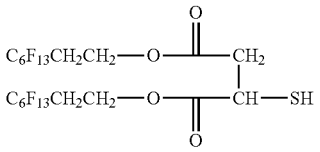

(a2-20)

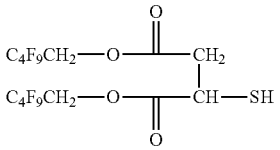

(a2-21)

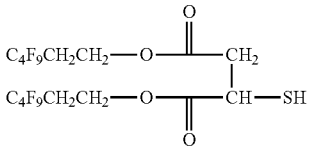

(a2-22)

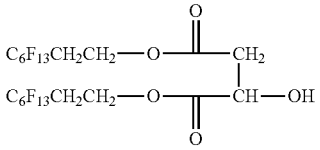

(a2-23)

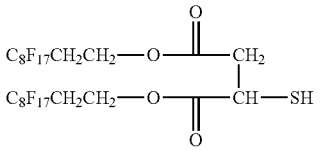

The feed ratio of the compound (a2) to the compound (a1) is adjusted arbitrarily depending on an intended physicality of the obtained photo-cured material. As long as the feed ratio is one at which more than or equal to two (meth)acryloyl groups remain after the Michael-addition reaction, the feed ratio is not limited to any particular one at all. Since the effects coming from fluorine atoms such as optical characteristics and, surface characteristics of the obtained cured material are exerted effectively, the feed ratio of the compound (a2) to 1 mol of the compound (a1) is preferably [0.01 to (k-2) mol (wherein k is an average number of (meth)acryloyl groups in one molecule)], more preferably [0.1 to (k-2) mol] and most preferably [1.0 to (k-2) mol].

The compound (a1) and compound (a2) are subjected to a usual Michael-addition reaction. No particular consideration need to be taken on contained fluorine atoms, and the reaction is performed with or without a solvent. The solvent is selected arbitrarily in view of the solubility and boiling point of the compound (a1) and compound (a2) and a used equipment. The illustrative examples of the solvents include esters such as ethyl acetate, butyl acetate and the like; halogenated hydrocarbons such as dichloromethane, 1,2-dichloroethene and the like; aromatic hydrocarbons such as toluene, xylene and the like; ketone such as acetone, methyl ethyl ketone (hereinafter, abbreviated as MEK), methyl isobutyl ketone (hereinafter, abbreviated as MIBK) and the like; alcohols such as ethanol, methanol, isopropanol and the like; polar aprotic compounds such as dimethylformamide, dimethylformacetamide, dimethylsulfoxide and the like; ethers such as diethylether, tetrahydrofurane and the like; and aliphatic hydrocarbons such as hexan, heptane and the like. These compounds may be used independently or as a mixture of more than or equal to two types of compounds. Preferable solvents are esters, aromatic hydrocarbons, ketones, alcohols, ethers, dimethylformacetamide and dimethylsulfoxide. Most preferable solvents are esters, ketones, alcohols and ethers.

The above-described reaction may be performed without a catalyst. However, reaction auxiliary agents such as a catalyst and the like are used in view of reaction efficiency. The illustrative examples of the reaction auxiliary agents include metal alcoholates such as sodium methoxide, sodium ethoxide and the like; amines such as trimethylamine, triethylamine, 1,4-diazabicyclo-[2.2.2]-octane and the like; metal hydrides such as sodium hydride, lithium hydride and the like; ammonium salts such as benzyltrimethylammonium hydroxide, tetraammonium fluoride and the like; and peroxides such as peracetic acid and the like. The preferable reaction auxiliary agents are metal alcoholates, amines and ammonium salts. The most preferable reaction auxiliary agents are amines. The used amount of a reaction auxiliary agent is not limited to any particular one. The reaction auxiliary agent is used preferably in an amount of 0.01 to 50% by mol to 1 mol of the compound (a1), and more preferably, in an amount of 0.1 to 20% by mol to 1 mol of the compound (a1).

Heat is used as a reaction activation energy source depending on the types of the compound (a1) and compound (a2). The reaction temperature is 0° C. to reflux temperature, preferably 20 to 100° C., and most preferably, 20 to 70° C. When a solvent is used at the time of reaction, the solvent has a concentration of 2 to 90% by mass and preferably of 20 to 80% by mass. The input sequence of reactive materials is not limited to any particular one. The obtained product may be purified by means of extraction, column chromatography or the like or may be used as it is. When a compound (a1) having many (meth)acryloyl groups is used, it is difficult to control the locations to which a compound (a2) is added, and there is obtained a fluorinated alkyl group-containing (meth)acrylate comprising a mixture of various compounds added to different locations. In this case, no single material need be taken out by means of isolation and purification, and there is used a mixture comprising various compounds subjected to the Michael-addition reaction at different locations.

The fluorinated alkyl group-containing (meth)acrylate used in the present invention is manufactured by means of a Michael-addition reaction of the compound (a1) and compound (a2). The Michael-addition reaction is performed under easier and milder conditions than a condensation reaction requiring a strong acid catalyst. The fluorinated alkyl group-containing (meth)acrylate (A) is commercially available or may be manufactured using easily synthesizable various multifunctional (meth)acrylates as starting materials. Therefore, depending on the demand characteristics of a photo-curing composition containing the fluorinated alkyl group-containing (meth)acrylate (A), the structure, fluorine atom content in one molecule and number of (meth)acryloyl groups of the fluorinated alkyl group-containing (meth)acrylate (A) can be adjusted arbitrarily.

The illustrative examples of the photopolymerization initiator (B) include:

B-1: Benzophenone;

B-2: Acetophenone;

B-3: Benzoin;

B-4: Benzoinethyl ether;

B-5: Benzoinisobutyl ether;

B-6: Benzoindimethyl ketal;

B-7: Azobisisobutylonitrile;

B-8: Hydroxycyclohexyl phenyl ketone; and

B-9: 2-hydroxy-2-methyl-1-phenylpropane-1-on. If desired, a photosensitizer such as an amine compound, phosphor compound or the like may be added, thereby enabling the polymerization further to be accelerated. B-1 to B-9 may be used independently, or more than or equal to two types of B-1 to B-9 may be concurrently used in combination.

More than or equal to two types of the starting agents may be used in combination depending on the type of a light source, intended curing rate, curing atmosphere and cured structure.

The ratio of the photopolymerization initiator (B) to the photo-curing composition is preferably 0.01 to 10% by mass and more preferably 0.1 to 7% by mass.

Another compound may be mixed with the fluorine-containing photo-curing composition depending on required performances. In this case, other functions are also given concurrently with exerting the optical and surface characteristics as performances coming from fluorine atoms.

In view of the mechanical characteristics such as high glass transition point (heat resistance), strength and the like and economy of the obtained cured material, another compound used in combination is preferably a non-fluorine mono(meth) acrylate (C).

The non-fluorine mono(meth)acrylate (C) is a compound containing not fluorine atoms, but acryloyl groups and/or methacryloyl groups in the molecules. The illustrative examples of the non-fluorine mono(meth)acrylate (C) include methyl (meth)acrylate; n-propyl (meth)acrylate; i-propyl (meth)acrylate; n-butyl(meth)acrylate; i-butyl (meth)acrylate; t-butyl (meth)acrylate; 2-ethylhexyl (meth) acrylate; oxtyl (meth)acrylate; decyl (meth)acrylate; isodecyl (meth)acrylate; lauryl (meth)acrylate; stearyl (meth)acrylate; isistearin (meth)acrylate; glycerol (meth)acrylate; 2-hydroxy (meth)acrylate; 3-chloro-2-hydroxy (meth)acrylate; glycidyl (meth)acrylate; allyl (meth)acrylate; butoxyethyl (meth) acrylate; butoxyethyleneglycol (meth)acrylate; γ-methcryloxypropyl trimethoxysilane, 2-methoxyethyl (meth)acrylate; methoxydiethyleneglycol (meth)acrylate; methoxydipropyleneglycol (meth)acrylate; nonylphenoxypolyethyleneglycol (meth)acrylate; nonylphenoxypolypropyleneglycol (meth)acrylate; Aronix M-5700 (made by TOAGOSEI CO., LTD.); phenoxyethyl (meth)acrylate; phenoxydipropyleneglycol (meth)acrylate; phenoxypolypropyleneglycol (meth)acrylate; AR-200, MR-260, AR-200, AR-204, AR-208, MR-200, MR-204, MR-208 (made by DAIHACHI CHEMICAL INDUSTRY CO., LTD.); BISCOAT 2000, BISCOAT 2308 (made by OSAKA ORGANIC CHEMICAL INDUSTRY LTD.); polybutadiene (meth)acrylate; polyethyleneglycol (meth)acrylate; polypropyleneglycol (meth)acrylate; polyethyleneglycol polypropyleneglycol (meth)acrylate; polyethyleneglycol polybutyleneglycol (meth)acrylate; polystyrylethyl (meth) acrylate; LIGHT ESTER HOA-MS, LIGHT ESTER HOMS (made by KYOEISHA CHEMICAL CO., LTD.); benzyl (meth)acrylate; cyclohexyl (meth)acrylate; dicyclopentanyl (meth)acrylate; dicyclopentenyl (meth)acrylate; isobornyl (meth)acrylate; methoxydized cyclodecatriene (meth)acrylate; phenyl(meth) acrylate; and FANCRYLFA-512A, FANCRYLFA-512M (made by HITACHI CHEMICAL CO., LTD.). These compounds may be used independently or as a mixture of more than or equal to two types of such compounds.

The preferable compounds are the following compounds having a high compatibility with the other ingredients in the photo curing composition, improving the transparency and translucency of the obtained cured material and containing ester-substituents having a cyclic structure:

C-1: Benzyl (meth)acrylate;
C-2: Cyclohexyl (meth)acrylate;
C-3: Dicyclopentanyl (meth)acrylate;
C-4: Dicyclopentenyl (meth)acrylate;
C-5: Isobornyl (meth)acrylate;
C-6: Methoxydized cyclodecatriene (meth)acrylate;
C-7: Phenyl (meth)acrylate;
C-8: FANCRYLFA-512A (Dicyclopentenyl acrylate made by HITACHI CHEMICAL CO., LTD.);
C-9: FANCRYLFA-512M (Dicyclopentenyloxyethyl methacrylate made by HITACHI CHEMICAL CO., LTD.);
C-10: Adamantyl (meth)acrylate; and
C-11: Dimethyladamantyl (meth)acrylate.

Further, a non-fluorine multifunctional monomer (D) may be used in combination. The non-fluorine multifunctional monomer (D) is a compound containing no fluorine atoms in the molecules and having more than or equal to two photopolymerizable functional groups. In the view of the compatibility with the other ingredients in the photo-curing composition and the translucency of the obtained cured material, the illustrative examples of the preferable non-fluorine multifunctional monomer (D) include the following compounds having (meth)acryloyl groups:

D-1: Ethyleneglycol di(meth)acrylate;
D-2: Diethyleneglycol di(meth)acrylate;
D-3: Triethyleneglycol di(meth)acrylate;
D-4: Polyethyleneglycol di(meth)acrylate (number average molecular weight: 150 to 1000);
D-5: Propyleneglycol di(meth)acrylate;
D-6: Dipropyleneglycol di(meth)acrylate;
D-7: Tripropyleneglycol di(meth)acrylate;
D-8: Polypropyleneglycol di(meth)acrylate (number average molecular weight: 150 to 1000);
D-9: Neopentylglycol di(meth)acrylate;
D-10: 1,3-butanediol di(meth)acrylate;
D-11: 1,4-butanediol di(meth)acrylate;
D-12: 1,6-hexanediol di(meth)acrylate;
D-13: Hydroxypivalate ester neopentylglycol di(meth)acrylate;

D-14

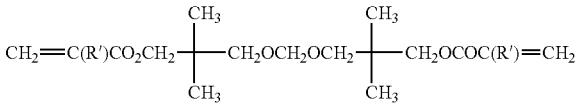

R': H or $CH_3$

D-15

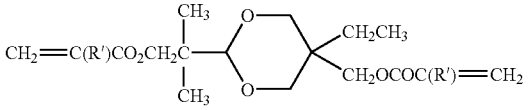

R': H or $CH_3$

D-16: Bisphenol A di(meth)acrylate;
D-17: Trimethylolpropane tri(meth)acrylate;
D-18: Pentaerythritol tri(meth)acrylate;
D-19: Dipentaerythritol hexa(meth)acrylate;
D-20: Pentaerythritol tetra(meth)acrylate;
D-21: Trimethylolpropane di(meth)acrylate;
D-22: Dipentaerythritol monohydroxy penta(meth)acrylate; and
D-23: Dicyclopentenyl (meth)acrylate.

Further, the illustrative examples of the non-fluorine multifunctional monomer (D) other than those described above include: NEOMER NA-305, NEOMER BA-601, NEOMER TA-505, NEOMER TA-401, NEOMER PHA-405X, NEOMER TA705X, NEOMER EA400X, NEOMER EE401X, NEOMER EP405X, NEOMER HB601X, NEOMER HB605X (made by Sanyo Chemical Industries LTD.); and KAYARAD HY-220, KAYARAD HX-620, KAYARAD D-310, KAYARAD D-320, KAYARAD D-330, KAYARAD DPHA, KAYARAD DPCA-20, KAYARAD DPCA-30, KAYARAD DPCA-60, KAYARAD DPCA-120 (made by NIPPON KAYAKU CO., LTD.).

One type or more than or equal to two types of non-fluorine multifunctional monomers (D) may be used.

A fluorine-containing (meth)acrylate (E) other than the fluorinated alkyl group-containing (meth)acrylate (A) may be contained in the photo-curing composition within the range of an amount that does not impair the advantages of the present invention. The illustrative examples of the fluorine-containing (meth)acrylate (E) includes the following compounds:

E-1: $CH_2{=}CHCOOCH_2CH_2C_8F_{17}$;
E-2: $CH_2{=}C(CH_3)COOCH_2CH_2C_8F_{17}$;
E-3: $CH_2{=}CHCOOCH_2CH_2C_{12}F_{25}$;
E-4: $CH_2{=}C(CH_3)COOCH_2CH_2C_{12}F_{25}$;
E-5: $CH_2{=}CHCOOCH_2CH_2C_{10}F_{21}$;
E-6: $CH_2{=}C(CH_3)COOCH_2CH_2C_{10}F_{21}$;
E-7: $CH_2{=}CHCOOCH_2CH_2C_6F_{13}$;
E-8: $CH_2{=}C(CH_3)COOCH_2CH_2C_6F_{13}$;
E-9: $CH_2{=}CHCOOCH_2CH_2C_4F_9$;
E-10: $CH_2{=}CFCOOCH_2CH_2C_6F_{13}$;
E-11: $CH_2{=}C(CH_3)COOCH_2CH_2C_{20}F_{41}$;
E-12: $CH_2{=}C(CH_3)COOCH_2CH_2C_4F_9$;
E-13: $CH_2{=}C(CF_3)COO(CH_2)_6C_{10}F_{21}$;
E-14: $CH_2{=}C(CH_3)COOCH_2CF_3$;
E-15: $CH_2{=}CHCOOCH_2CF_3$;
E-16: $CH_2{=}CHCOOCH_2C_8F_{17}$;
E-17: $CH_2{=}C(CH_3)COOCH_2C_8F_{17}$;
E-18: $CH_2{=}C(CH_3)COOCH_2C_{20}F_{41}$;
E-19: $CH_2{=}CHCOOCH_2C_{20}F_{41}$;
E-20: $CH_2{=}C(CH_3)COOCH_2CF(CF_3)_2$;
E-21: $CH_2{=}C(CH_3)COOCH_2CFHCF_3$;
E-22: $CH_2{=}CFCOOCH_2C_2F_5$;
E-23: $CH_2{=}CHCOOCH_2(CH_2)_6CF(CF_3)_2$;
E-24: $CH_2{=}C(CH_3)COOCH_2CF_2CFHCF_3$;
E-25: $CH_2{=}C(CH_3)COOCH(C_2H_5)C_{10}F_{21}$;
E-26: $CH_2{=}CHCOOCH_2(CF_2)_2H$;
E-27: $CH_2{=}C(CH_3)COOCH_2(CF_2)_2H$;
E-28: $CH_2{=}CHCOOCH_2(CF_2)_4H$;
E-29: $CH_2{=}CHCOOCH_2CF_3$;
E-30: $CH_2{=}C(CH_3)COO(CF_2)_4H$;
E-31: $CH_2{=}CHCOOCH_2(CF_2)_6H$;
E-32: $CH_2{=}C(CH_3)COOCH_2(CF_2)_6H$;
E-33: $CH_2{=}CHCOOCH_2(CF_2)_8H$;
E-34: $CH_2{=}C(CH_3)COOCH_2(CF_2)_8H$;
E-35: $CH_2{=}CHCOOCH_2(CF_2)_{10}H$;
E-36: $CH_2{=}CHCOOCH_2(CF_2)_{12}H$;
E-37: $CH_2{=}CHCOOCH_2(CF_2)_{14}H$;
E-38: $CH_2{=}CHCOOCH_2(CF_2)_{18}H$;
E-39: $CH_2{=}CHCOOC(CH_3)_2(CF_2)_4H$;
E-40: $CH_2{=}CHCOOCH_2(CF_2)_7H$;
E-41: $CH_2{=}C(CH_3)COOCH_2CH_2(CF_2)_7H$;
E-42: $CH_2{=}C(CH_3)COOC(CH_3)_2(CF_2)_6H$;

E-43: $CH_2{=}CHCOOCH(CF_3)C_8F_{17}$;
E-44: $CH_2{=}CHCOOCH_2C_2F_5$; and
E-45: $CH_2{=}CHCOO(CH_2)_2(CF_2)_8CF(CF_3)_2$.

The fluorine-containing (meth)acrylate (E) lowers the refractive index of the obtained cured material. When a fluorinated polymer (F) as described below is introduced, a mixture viscosity providing intended applicability and formability to the fluorine-containing photo-curing composition can be easily adjusted without lowering the translucency of the cured material.

A fluorinated polymer (F) may be used for maintaining the transparency of the fluorine-containing photo-curing composition and improving the low refractive index and mechanical strength of the obtained cured material. The illustrative examples of the fluorinated polymer (F) include: a homopolymer of the fluorine-containing (meth)acrylate (E); and a copolymer comprising the fluorine-containing (meth)acrylate (E) and one type or more than or equal to two types of non-fluorine (meth)acrylates (C).

The method of manufacturing the polymer (F) is not limited to any particular one at all. Based upon the polymerization mechanism such as radical polymerization method, cationic polymerization method, anionic polymerization method or the like, the polymer (F) is manufactured by being subjected to the irradiation of polymerization initiating energy such as heat, light, electron beam, nuclear radiation or the like by means of solution polymerization method, mass polymerization method, emulsion polymerization method or the like. The industrially preferable manufacturing method is a radical polymerization method using heat and/or light as initiating energy.

When the polymerization initiating energy is heat, various heat polymerization initiator can be used without limitation. The illustrative examples of the heat polymerization initiator include peroxides such as benzoyl peroxide, diasyl peroxide and the like; azo compounds such as azobisisobutylonitrile, phenylazotriphenylmethane and the like; and metal chelate compounds such as $Mn(acac)_3$ and the like. When light such as ultraviolet light or the like is used, a light polymerization initiator (for example, one of the compounds described in B-1 to B-9 above) is used. By adding a photosensitizer such as an amine compound, a phosphor compound or the like, if needed, the polymerization is accelerated. When the polymer is obtained using electron beam or nuclear radiation, no addition of a polymerization initiator is required.

When radical polymerization is performed, various chain transfer agents are used concurrently, if needed, to adjust the molecular weight. The illustrative examples of the chain transfer agents include laurylmercaptane, 2-mercaptoethanol, ethylthioglycolic acid, octylthioglycolic acid, and γ-mercaptopropyltrimethoxysilane.

When solution polymerization is performed, the solvent is not limited to any particular one. The illustrative examples of the solvent include: alcohols such as ethanol, isopropyl alcohol, n-butanol, iso-butanol, tert-butanol and the like; ketones such as acetone, MEK, MIBK, methylamylketone and the like; esters such as methyl acetate, ethyl acetate, butyl acetate, methyl lactate, ethyl lactate, butyl lactate and the like; monocarboxylic acid esters such as 2-methyl oxypropionate, 2-ethyl oxypropionate, 2-propyl oxypropionate, 2-butyl oxypropionate, 2-methyl methoxypropionate, 2-ethyl methoxypropionate, 2-propyl methoxypropionate, 2-butyl methoxypropionate and the like; polar solvents such as dimethylformamide, dimethylsulfoxide, N-methylpyrrolidone and the like; ethers such as methyl cellosolve, cellosolve, butyl cellosolve, butyl carbitol, ethyl cellosolve acetate and the like; propylene glycols and esters thereof such as propylene glycol, propylene glycol monomethyl ether, propylene glycol monomethyl ether acetate, propylene glycol monoethyl ether acetate, propylene glycol mononbutyl ether acetate and the like; halogenated hydrocarbons such as 1,1,1-trichloroethane, chloroform and the like; ethers such as tetrahydrofurane, dioxane and the like; aromatic hydrocarbons such as benzene, toluene, xylene and the like; and fluorinated inert liquids such as perfluorooctane, perfluorotri-n-butylamine and the like.

When the fluorinated polymer (F) is a copolymer, the sequence of block, alternation and random is determined depending on the combination of monomers. Further, the sequence is controlled depending on a selected polymerization mechanism, initiator and chain transfer agent. One type or more than or equal to two types of homopolymers and/or copolymers are used.

The molecular weight and molecular weight distribution of the fluorinated polymer (F) are not limited to any particular ones. The polymer (F) has a molecular weight of 2,000 to 3,000,000 and preferably of 5,000 to 2,000,000. More than or equal to two types of polymers may be added to the composition in view of viscosity, workability, exerted mechanical characteristics and the like.

The fluorinated polymer (F) may be added in a form of fluorine resin fine particles to the composition. The fluorinated polymer (F) improves the oil repellency of the composition and exerts a highly resistant oil repellency function.

The illustrative examples of the fluorine resins composing the fluorine resin fine particles include: polytetrafluoroethylene; polychlorotrifluoroethylene; polyvinylidene fluoride; polydichlorodifluoroethylene; tetrafluoroethylene-perfluoroalkylvinylether copolymer; tetrafluoroethylene-hexafluoropropylene copolymer; tetrafluoroethylene-ethylene copolymer; and tetrafluoroethylene-hexafluoropropylene-perfluoroalkylvinylether copolymer. The respective fluorine resin fine particles have a diameter of 0.01 to 10 μm, preferably of 0.05 to 2.0 μm. More than or equal to two types of fluorine resin fine particles may be used.

Since the fluorine resin fine particles tend to reduce the photosensitivity in the photoconductive layer slightly, the content thereof in the surface protection layer is less than or equal to 10% by mass and preferably 0.5% by mass to 5% by mass.

The fluorine-containing photo-curing composition is diluted by an organic solvent such as methyl cellosolve or the like so as to have a solid content of 4% by mass to 60% by weight, thereby obtaining a coating liquid. Subsequently, the coating liquid is applied on a conductive support such as a photoconductor drum or the like by means of immersion coating, ring coating and/or spray coating.

After being coated as a layer on the conductive support, the fluorine-containing photo-curing composition used in the present invention is subjected to polymerization curing by means of light irradiation to obtain a desired cured material layer. According to circumstances, heat may be used concurrently as a heat resource. At this time, there may be used polymerization initiator such as azobisisobutylonitrile, benzoin peroxide, methylethylketone peroxide cobalt naphthenate and the like.

The light source during photo polymerization curing is not limited to any particular one. The illustrative examples of the light source include: sterilizing lamp; ultraviolet fluorescent lamp; carbon arc lamp; xenon lamp; high-pressure mercury lamp for copying; middle-pressure mercury lamp; high-pressure mercury lamp; ultra-high-pressure mercury lamp; electrodeless lamp; metal halide lamp; ultraviolet light coming from natural light; and scanning or curtain electron accelerator.

The irradiance level of the ultraviolet light is 100 mJ/cm$^2$ to 500 mJ/cm$^2$ and preferably 140 mJ/cm$^2$ to 350 mJ/cm$^2$. The irradiance time of the ultraviolet light is 10 seconds to 60 seconds and preferably 15 seconds to 40 seconds.

The surface protection layer of the organic photoconductor has a film thickness of 0.1 μm to 3 μm, preferably of 0.15 μm to 2.5 μm. When the film thickness is less than 0.1 μm, the oil repellency function of the organic photoconductor is deteriorated. When the film thickness is more than 3 μm, the light attenuation residual potential of the organic photoconductor is increased. The surface protection layer of the inorganic photoconductor has a film thickness of 0.2 μm to 1.5 μm.

The fluorine-containing photo-curing composition used in the present invention has optical characteristics such as low refractive index, transparency and the like, mechanical characteristics such as dimension stability, strength and the like, and further surface characteristics coming from fluorine atoms, is unlikely to be subjected to chemical deteriorations such as hydrolysis and the like, and has a good wet heat resistance, thereby enabling a cured material capable of maintaining the above-described performances steadily for a long time to be obtained.

The content of the fluorine atoms in the surface protection layer is adjusted so as to be 8.5% by mass to 20% by mass. When the content of the fluorine atoms in the surface protection layer is less than 8.5% by mass, the strength of the surface protection layer becomes insufficient and the contact angle to vegetable oil does not become high.

The surface protection layer of the photoconductor of the present invention has a high surface strength. Further, the contact angle of soybean oil on the surface protection layer is 60° to 90°. Thus, only a small amount of carrier liquid adheres to the non-image area. The image-forming apparatus having incorporated this photoconductor uses only a small amount of cleaning toner.

The surface protection layer has a surface resistivity of $1\times10^{13}$ Ω·cm to $5.0\times10^{15}$ Ω·cm at 25° C.

The liquid developing agent used in the present invention is a positively-charging liquid developing agent which contains vegetable oil as a carrier liquid and in which basic treatment pigments, an acidic polymer dispersant and the like are dispersed.

The illustrative examples of the vegetable oil available as a carrier liquid include: soybean oil; safflower oil; sunflower seed oil; corn oil; cotton seed oil; canola oil; and linseed oil.

The illustrative examples of the inorganic pigments as coloring agents include: Furnace Black, Acetylene Black, Channel Black, Printex G, Printex V, Special Black 4, Special Black 4-b (made by DEGUSSA CO., LTD.); MITSUBISHI #44, #30, MA-11, MA-100 (made by MITSUBISHI CHEMICAL CORPORATION); RABEN 30, RABEN 40, CONDUCTEX SC (made by COLUMBIA CARBON CO.); and REGAL 400, 660, 800, BLACK PEARL L (made by CABOT CORPORATION). Further, the other illustrative examples of the inorganic pigments include inorganic white pigments such as zinc oxide, titanium oxide, silicon oxide and the like.

The illustrative examples of the organic pigments include: phthalocyanine blue; phthalocyanine green; rhodamine lake; malachite green lake; methyl violet lake; peacock blue lake; naphthol green B; permanent red 4R; Hansa yellow; benzidine yellow; and thioindigo red.

The above-described pigments are treated by the resins described below and a basic polymer dispersant in the presence of methyl ethyl ketone, water and oleic acid to obtain basic treatment pigments. The illustrative examples of the basic polymer dispersant include: AJISPA PB-822 made by AJINOMONOTO-FINE-TECHNO CO., INC.; HINOACT 7000 made by KAWAKEN FINE CHEMICALS CO., LTD.; and SOLSPER 32000 made by AVECIA CO., LTD. The illustrative examples of the resins used for treating the pigments include: polyester resins; ethylene-vinyl acetate copolymers; styrene-acrylic resins; rosin-modified resins; polyethylene; ethylene-acrylic acid copolymers; ethylene maleic anhydride copolymers; polyvinylpyridine; polyvinylpyrrolidone; ethylene-methacrylic acid copolymers; and ethylene-acrylic acid ester copolymers. One type or more than or equal to two types of such resins are used.

The basic treatment pigments are contained at a ratio of 8 to 50% by mass and preferably 10 to 40% by mass to the liquid developing agent.

Oleic acid used in preparing the basic treatment pigments is a higher unsaturated fatty acid that is liquid at room temperature and is used as a viscosity modifier for the liquid developing agent, a charge control agent and a solvent for preparing treatment pigments. Oleic acid is contained at a ratio of 5 to 60% by mass and preferably 10 to 50% by mass to the liquid developing agent.

An acidic polymer dispersant is added for improving the dispersibility of the basic treatment pigments in the liquid developing agent. The illustrative examples of the acidic polymer dispersant include: AJISPA PA-111 made by AJINOMONOTO-FINE-TECHNO CO., INC.; KF-10000 made by KAWAKEN FINE CHEMICALS CO., LTD.; and ALFA RESIN SA-300 made by ALFA KAKEN CORPORATION. The acidic polymer dispersant is contained at a ratio of 0.1 to 1% by mass and preferably 0.2 to 0.5% by mass to the liquid developing agent.

The liquid developing agent of the present invention may contain a charge control agent, if needed. The illustrative examples of the charge control agent include: titanium chelate such as tetraethyl titanate; tetraisopropyl titanate, tetra-n-propyl titanate, tetra-n-butyl titanate, tetra-tert-butyl titanate, tetra-2-ethylhexyl titanate, tetraoctyl titanate, tetramethoxytitanium, titanylacetyl acetate and the like; and titanate coupling agents such as isopropyltriisostearoyl titanate, isopropyltridecylbenzenesulfonyl titanate, isopropyltris(dioctylpyrrophosphate) titanate, tetraisopropylbis(dioctylphosphite) titanate, tetraoctylbis(ditridecylphosphite) titanate, tetra(2,2-diallyloxydylmethyl-1-butyl)bis(ditridecyl), bis(dioxtylpyrophosphate)ethylene tinanate, isopropyltrioctanoyl titanate, isopropyldimetacrylisostearoyl titanate, isopropylisostearoyldiacryl titanate, isopropyltri(dioctylphosphate) titanate, isopropyltricumylphenyl titanate, isopropyltri(N-aminoethyl-aminoethyl)titanate and the like.

The liquid developing agent used in the present invention may contain an antioxidizing agent, an antiaging agent and a ultraviolet absorbing agent.

For the liquid developing agent used in the present invention, there are dispersed, in the carrier liquid, raw materials such as basic treatment pigments, an acidic polymer dispersant and the like by means of a dispersing device such as attritor, sand mill, ball mill, vibration mill or the like. The colored fine particles in the liquid developing agent used in the present invention has preferably a primary particle diameter of less than or equal to 1 μm as number average diameter.

The liquid developing agent used in the present invention has a toner concentration of 5 to 40% by mass and a viscosity (25° C.) of 50 mPa s to 1000 mPa s. The liquid developing has an electric resistivity of $1\times10^{10}$ Ω·cm to $5\times10^{14}$ Ω·cm at 25° C. The liquid developing agent used in the present invention has a high concentration and a high viscosity, and is further non-volatile at room temperature.

Figure 2:
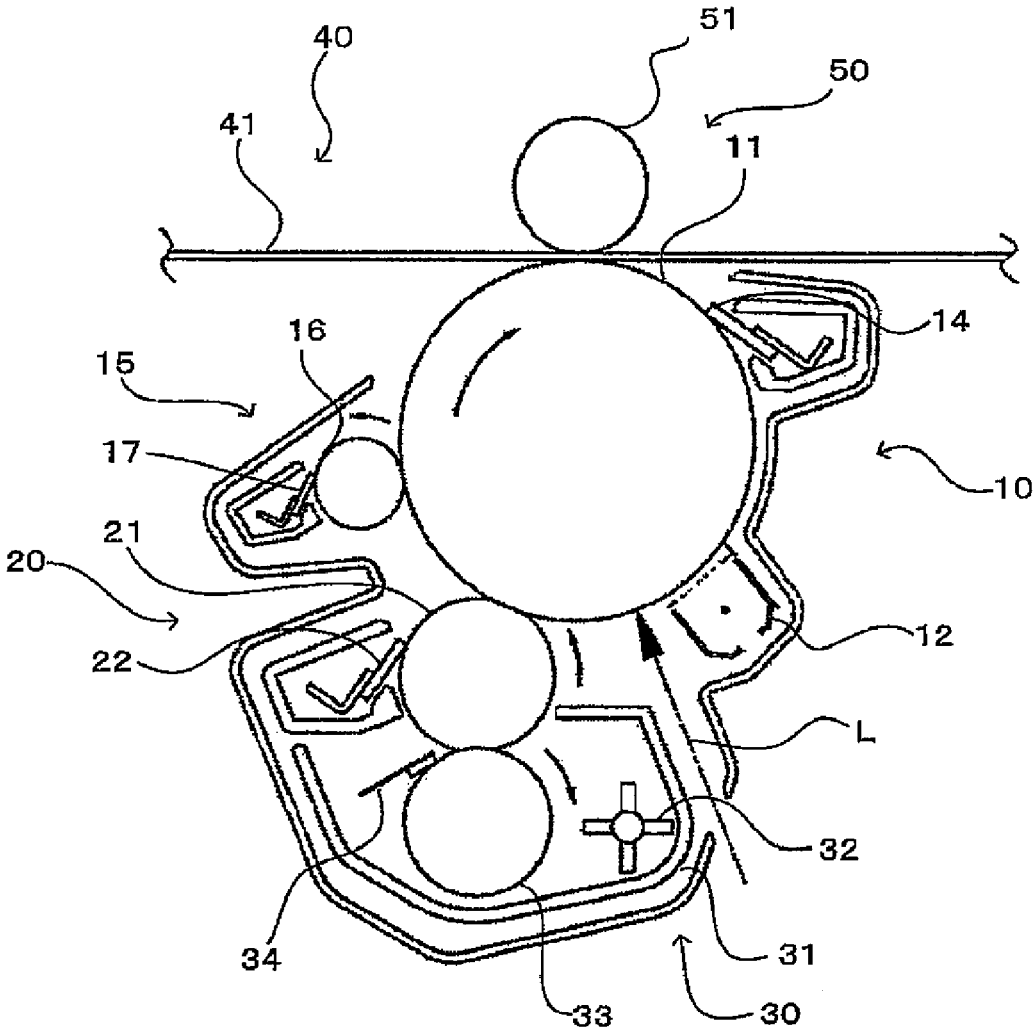
FIG. 2 is a view illustrating a photoconductor cartridge.

FIG. 2 is a view showing one embodiment of a photoconductor cartridge in which the photoconductor of the present invention is incorporated.

In an image-forming unit 10 of the photoconductor cartridge, there are arranged a charging unit 12, a developing unit 20, a photoconductor squeeze unit 15 and a photoconductor drum cleaning blade 14 as an example of an image carrier cleaning unit along the rotational direction of the outer periphery of a photoconductor drum 11 as one example of an image carrier. An intermediate transfer unit 40 is arranged between the photoconductor squeeze unit 15 and the photoconductor drum cleaning blade 14.

In the developing unit 20, there are arranged a developing roller cleaning blade 22 as one example of a developing member cleaning unit and a developing agent feeding unit 30 on the outer periphery of a developing roller 21 as one example of a developing member.

The developing agent feeding unit 30 has a liquid developing agent reservoir 31, an agitating screw 32 as one example of an agitating unit, an anilox roller 33 as one example of a developing agent feeding member, and a regulating blade 34 as one example of a regulating member. The liquid developing agent, agitating screw 32, anilox roller 33 and regulating blade 34 are contained in the developing agent reservoir 31. In the position of the intermediate transfer unit 40 opposed to the photoconductor drum 11, there is arranged a primary transfer roller 51 of a primary transfer unit 50 via an intermediate transfer belt 41 as one example of an intermediate transfer body.

The photoconductor drum 11 has a larger width than the developing roller 21 and comprises a cylindrical member on the outer peripheral surface of which a photosensitive layer is formed. The photoconductor drum 11 is rotated clockwise in FIG. 2 by a drive means (not shown).

The charging unit 12 is arranged on the upstream side of the rotational direction of the photoconductor drum 11 by a nip portion between the photoconductor drum 11 and the developing roller 21 and charges the photoconductor drum 11 uniformly about to 600 V in the dark by means of corona discharge. The illustrative examples of the charging unit 12 include: a corona discharge charging unit; and a charging unit that applied a predetermined charging bias to a charging roller that has been brought into contact with the photoconductor drum 11.

The photoconductor drum cleaning blade 14 comes into contact with the surface of the photoconductor drum 11, scrapes off and removes the remaining developing agent mainly comprising the carrier liquid from the photoconductor drum 11 that has passed through the primary transfer unit, and initializes the surface of the photoconductor drum 11.

In the developing unit 20, there are provided the developing roller 21, the developing roller cleaning blade 22, and the developing agent feeding unit 30. The developing agent feeding unit 30 has the liquid developing agent reservoir 31, the agitating screw 32, the anilox roller 33, and the regulating blade 34. The liquid developing agent, agitating screw 32, anilox roller 33 and regulating blade 34 are contained in the developing agent reservoir 31.

The agitating screw 31 is arranged so as to be immersed in the liquid developing agent in the tank and is driven to be rotated by means of a drive means (not shown). When the developing unit 20 comes into a developing operation, the agitating screw 32 is rotated to agitate the liquid developing agent in the developing agent reservoir 31, thereby equalizing the toner concentration and viscosity of the liquid developing agent.

The anilox roller 33 is a cylindrical member and rotates in the same direction as in the rotational direction of the photoconductor drum 11. A corrugated surface is formed on the surface of the anilox roller 33 by means of fine and uniformly spiral recesses so that the liquid developing agent is easily supported on the surface of the anilox roller 33. The recesses have a pitch of about 130 μm and a depth of about 30 μm, respectively. The liquid developing agent is fed from the developing agent reservoir 31 to the developing roller 21 by means of the anilox roller 33.

The regulating blade 34 is a blade formed from a spring material such as phosphor bronze or the like on the tip of which a rubber piece is adhered or from a metal such as stainless steel or the like. The regulating blade 34 comes into contact with the rotating anilox roller 33 and scrapes off the liquid developing agent on the anilox roller 33. Then the amount of the liquid developing agent to be supported on the anilox roller 33 is precisely determined so as to take a value corresponding to the volume of a plurality of recesses, thereby adjusting the amount of the liquid developing agent fed to the developing roller 21. The rotational direction of the anilox roller 33 may be opposite to that of the photoconductor drum 11, and then the regulating blade 34 is arranged corresponding to the rotational direction.

The developing roller 21 is a cylindrical member and rotates in a direction opposite to the rotational direction of the photoconductor drum 11. A conductive elastic layer comprising urethane rubber or the like is provided on the outer peripheral portion of the developing roller 21. The developing roller 21 develops electrostatic latent images on the photoconductor drum 11 by means of the liquid developing agent fed from the anilox roller 33.

The developing roller cleaning blade 22 is composed of metal or rubber. The developing roller cleaning blade 22 is arranged on the downstream side of the rotational direction of the developing roller 22 from the developing nip portion where the developing roller 21 comes into contact with the photoconductor drum 11. The cleaning blade 22 scrapes off and removes the liquid developing agent remaining on the developing roller 21. The removed liquid developing agent is stored in the developing agent reservoir 31 via a return portion. In the present invention, although the developing roller cleaning blade 22 is illustrated as a developing member cleaning unit the developing member cleaning unit may be a roller.

The photoconductor squeeze unit 15 has a squeeze roller 16 and a squeeze cleaner 17. The squeeze roller 16 is provided on the downstream side of the rotational direction of the photoconductor drum 11 from the contact portion (nip portion) between the photoconductor drum 11 and the developing roller 21. The squeeze roller 16 is rotated in a direction opposite to the photoconductor drum 11 and removes the toner and separated carrier liquid on the photoconductor drum 11.

The preferable squeeze roller 16 is an elastic roller having an elastic member such as conductive urethane rubber or the like and a fluorine resin surface layer provided on the surface of a metallic cored bar thereof. The squeeze roller cleaner 17 comprises an elastic body such rubber or the like and is brought into contact with the surface of the squeeze roller 16, thereby scraping off and removing the carrier liquid remaining on the squeeze roller 16. In the present embodiment, although the squeeze roller cleaner 17 is illustrated as a squeeze roller cleaning unit, the squeeze roller cleaning unit may be a roller.

In the primary transfer unit 50, the primary transfer roller 51 and the photoconductor drum 11 are provided opposed to each other with an intermediate transfer belt 41 in between. The contact position between the photoconductor drum 11 and the intermediate transfer belt 41 is set as a primary transfer position, and the developed toner images on the photoconductor drum 11 are transferred on the intermediate transfer belt 41 to form toner images.

Figure 3:
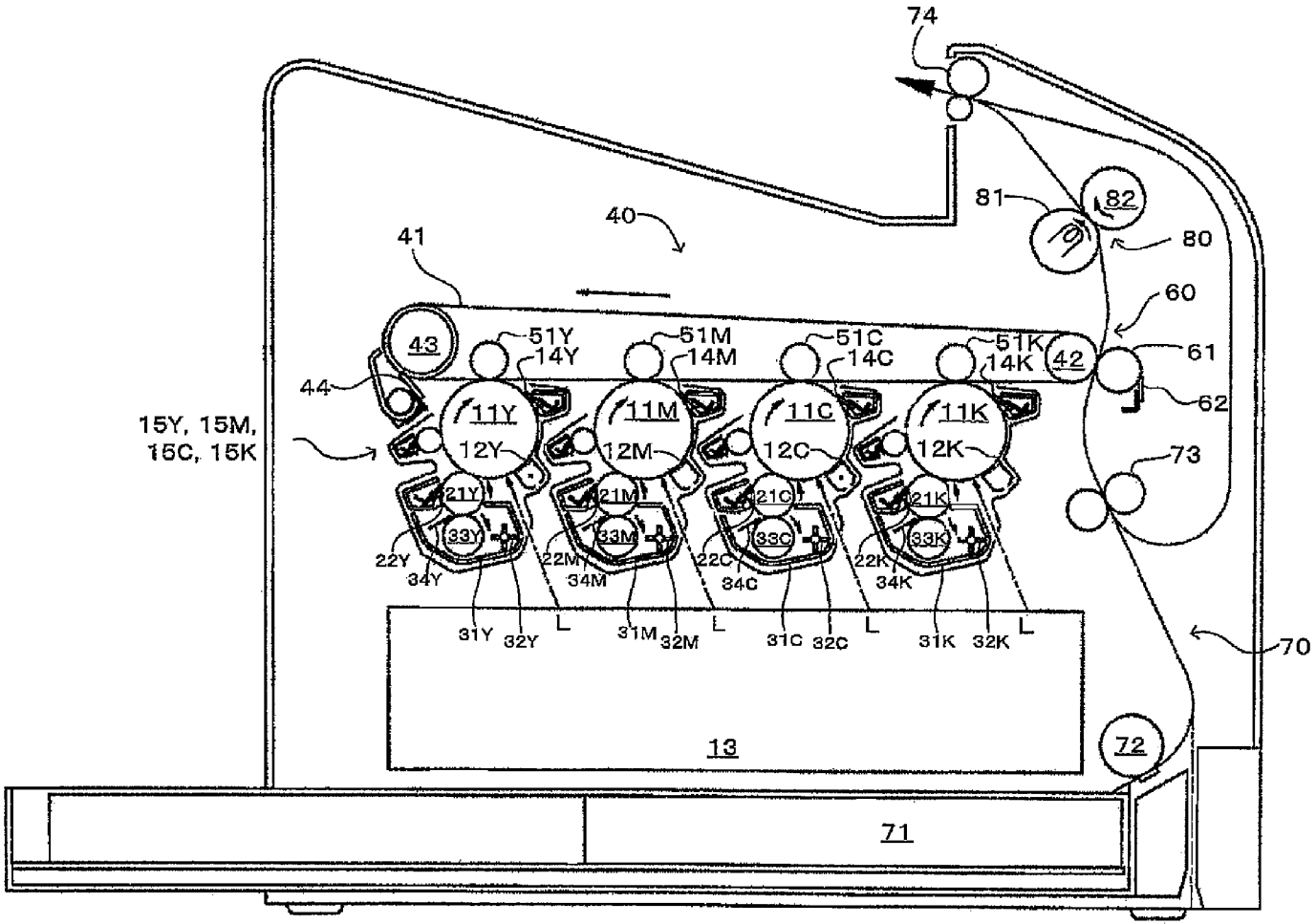
FIG. 3 is a view illustrating a tandem printer.

FIG. 3 is a view showing a tandem printer as one embodiment of an image-forming apparatus in which the photoconductor cartridge of the present invention is incorporated. In the tandem printer, the image-forming units 10 and four developing units 20 shown in FIG. 2 are arranged respectively, and images are formed by means of liquid developing agents of colors comprising yellow (Y), magenta (M), cyan (C) and black (K).

In image-forming units 10Y, 10M, 10C and 10K, photoconductor drums 11Y, 11M, 11C and 11K are charged equally by means of charging units 12Y 12M, 12C and 12K. Irradiation of laser beam modulated based upon input image signals is performed by means of exposure L from exposure units 13Y, 13M, 13C and 13K having an optical system such as semiconductor laser, polygon mirror, F-θ lens or the like. Then, electrostatic latent images are formed on the charged photoconductor drums 11Y, 11M, 11C and 11K.

Developing units 20Y, 20M, 20C and 20K develop the electrostatic latent images formed on the photoconductor drums 11Y, 11M, 11C and 11K by means of the liquid developing agents of colors comprising yellow (Y), magenta (M), cyan (C) and black (K).

First, when the developing units 20Y, 20M, 20C and 20K come into a developing operation, agitating screws 32Y, 32M, 32C and 32K are rotated to agitate the liquid developing agents in the developing agent reservoirs 31Y, 31M, 31C and 31K, thereby equalizing the toner concentrations and viscosities of the liquid developing agents.

Then, anilox rollers 33Y, 33M, 33C and 33K are driven to be rotated by drive means (not shown) to pump the liquid developing agents adhered to the anilox rollers 33Y, 33M, 33C and 33K. Regulating blades 34Y, 34M, 34C and 34K are brought into contact with the rotating anilox rollers 33Y, 33M, 33C and 33K to scrape off the liquid developing agents on the anilox rollers 33Y, 33M, 33C and 33K. Then, the amount of the liquid developing agents on the anilox rollers 33Y, 33M, 33C and 33K is precisely determined so as to take a value corresponding to the volume of a plurality of recesses. The liquid developing agents that have been scraped off by means of the regulating blades 34Y, 34M, 34C and 34K fall by gravity into the developing agent reservoirs 31Y, 31M, 31C and 31K respectively. On the other hand, the liquid developing agents that have not been scraped off by means of the regulating blades 34Y, 34M, 34C and 34K are contained within the recesses of the corrugated surface of the anilox rollers 33Y, 33M, 33C and 33K, are brought into contact with the developing rollers 21Y, 21M, 21C and 21K by pressure and are applied on the surfaces of the developing rollers 21Y, 21M, 21C and 21K.

The developing rollers 21Y, 21M, 21C and 21K rotate at the same speed as the photoconductor drums 11Y, 11M, 11C and 11K and come into contact with them to form developing nips respectively. Developing biases having the same polarity as the charging polarity of the toner are applied on these developing nips from a power source (not shown), and developing electric fields are formed due to the potential differences between the developing rollers 21Y, 21M, 21C and 21K and the photoconductor drums 11Y, 11M, 11C and 11K respectively. Specifically, in the developing nips, the non-image areas and electrostatic latent images of the developing rollers 21Y, 21M, 21C and 21K and the photoconductor drums 11Y, 11M, 11C and 11K have the potentials of the same polarity as the toner respectively, and the values of the potentials becomes lower in the sequence of the non-image areas of the photoconductor drums 11Y, 11M, 11C and 11K, the developing rollers 21Y, 21M, 21C and 21K, and the electrostatic latent images.

Thus, between the non-image areas of the photoconductor drums 11Y, 11M, 11C and 11K and the developing rollers 21Y, 21M, 21C and 21K, there are formed electric fields where the toners are moved electrostatically toward the developing rollers 21Y, 21M, 21C and 21K having lower potentials. Between the developing rollers 21Y, 21M, 21C and 21K and the electrostatic latent images of the photoconductor drums 11Y, 11M, 11C and 11K, there are formed electric fields where the toners are moved toward the electrostatic latent images of the photoconductor drums 11Y, 11M, 11C and 11K having lower potentials.

In the developing nips where the developing electric fields are formed, the toners in the developing agent thin layers are concentrated by being eletrophoresed toward the surfaces of the developing rollers 21Y, 21M, 21C and 21K between the developing rollers 21Y, 21M, 21C and 21K and the non-image areas of the photoconductor drums 11Y, 11M, 11C and 11K. Concurrently, the toners are eletrophoresed toward the electrostatic latent images of the photoconductor drums 11Y, 11M, 11C and 11K between the developing rollers 21Y, 21M, 21C and 21K and the electrostatic latent images of the photoconductor drums 11Y, 11M, 11C and 11K, resulting in adhesion of the toner to the photoconductor drums 11Y, 11M, 11C and 11K. Then, the electrostatic latent images of the photoconductor drums 11Y, 11M, 11C and 11K are developed to form toner images.

After having passed through the developing nips, the remaining liquid developing agents of the developing rollers 21Y, 21M, 21C and 21K are scraped off to be removed by means of the developing roller cleaning blades 22Y, 22M, 22C and 22K coming into contact with the surfaces of the developing rollers 21Y, 21M, 21C and 21K. Then, the surfaces of the developing rollers 21Y, 21M, 21C and 21K are initialized. The removed remaining developing agents return to the developing agent reservoirs 31Y, 31M, 31C and 31K via return portions.

The squeeze rollers 16Y, 16M, 16C and 16K are rotated in directions opposite to the photoconductor drums 11Y, 11M, 11C and 11K and remove carrier liquid separated from the toners on the photoconductor drums 11Y, 11M, 11C and 11K.

The squeeze roller cleaners 17Y, 17M, 17C and 17K are brought into contact with the surfaces of the squeeze rollers 16Y, 16M, 16C and 16K to scrape off and remove the carrier liquid on the squeeze rollers 16Y, 16M, 16C and 16K.

Subsequently, in primary transfer units 50Y, 50M, 50C and 50K where the photoconductor drums 11Y, 11M, 11C and 11K and primary transfer rollers 51Y, 51M, 51C and 51K are opposed to each other respectively with an intermediate transfer belt 41 in between, a polarity opposite to the charging characteristic of the toners is applied on the primary transfer rollers 51Y, 51M, 51C and 51K. Then, the contact positions between the photoconductor drums 11Y, 11M, 11C and 11K and the primary transfer rollers 51Y, 51M, 51C and 51K are set as primary transfer positions. The toners are transferred primarily from the photoconductor drums 11Y, 11M, 11C and 11K to the intermediate transfer belt 41, revealed toner images of the respective colors are transferred primarily to the intermediate transfer belt 41 repeatedly in series, thereby forming full-color toner images.

Only the carrier liquid remains on the photoconductor drums 11Y, 11M, 11C and 11K. The carrier liquid remaining on the photoconductor drums 11Y, 11M, 11C and 11K after primary transfer is scraped off by means of the photoconductor drum cleaning blades 14Y, 14M, 14C and 14K on the downstream side of the rotational direction of the photoconductor drums 11Y, 11M, 11C and 11K from the primary transfer units 50Y, 50M, 50C and 50K.

The toner images transferred primarily to the intermediate transfer belt 41 move to a secondary transfer unit 60 and come into a nip portion between a driving roller 42 and a secondary transfer roller 61 via the intermediate transfer belt 41. In the secondary transfer unit 60, the driving roller 42 and the secondary transfer roller 61 are impressed in polarities opposite to each other. Single-color or full-color toner images formed on the intermediate transfer belt 41 are transferred to a recording medium P as a transfer material such as paper, film, cloth or the like in a recording medium delivery unit 70.

In the secondary transfer unit 60, the recording medium P is fed corresponding to a timing in which a repeatedly colored toner image on the intermediate transfer belt 41 reaches a secondary transfer area, thereby transferring the toner image on the recording medium P secondarily. If there occurs any feed trouble of the recording medium P such as jam or the like, the toner image is transferred by coming into contact with the secondary transfer roller 61 without the recording medium P, resulting in a dirty reverse side of the recording medium P.

The secondary transfer roller 61 comprises an elastic roller of which surface is coated with an elastic body so that the toner image may be transferred secondarily corresponding to the surface of the recording medium P that is not smooth due to fibers and the like. The secondary transfer roller cleaning blade 62 is a means for removing liquid developing agent (toner dispersed in the carrier liquid) transferred to the secondary transfer roller 61 and recovers the liquid developing agent from the secondary transfer roller 61. The pooled liquid developing agent is in a mixed state of colors and may contain foreign matters such as paper powder and the like.

After having passed through the secondary transfer unit 60, the intermediate transfer belt 41 moves to a driven roller 43. If there occurs any feed trouble of the recording medium P such as jam or the like, the toner image is not completely transferred to the secondary transfer roller 61 and a part thereof remains on the intermediate transfer belt 41. The toner image on the intermediate transfer belt 41 is not completely transferred secondarily to the recording medium P in a normal secondary transfer process, resulting in several percent of remaining secondary transfer. The unnecessary toner image is cleaned by means of an intermediate transfer belt cleaning blade 44 as one example of an intermediate transfer body cleaning unit arranged so as to come into contact with the intermediate transfer belt 41 for forming an image subsequently. Then, the intermediate transfer belt 41 moves to the primary transfer units 50Y, 50M, 50C and 50K again.

In addition, the intermediate transfer unit 40 comprises an intermediate transfer belt 41, a driving roller 42, a driven roller 43 and an intermediate transfer belt cleaning blade 44. The secondary transfer unit 60 comprises a secondary transfer roller 61 and a secondary transfer roller cleaning blade 62.

In the recording medium delivery unit 70, one sheet of the recording medium P such as stacked paper or the like in a paper cassette 71 is separated by means of a feed roller 72 and is fed to the secondary transfer unit 60 via a gate roller 73 or the like correcting the oblique motion and feed timing of the recording medium P. In the secondary transfer unit 60, a full-color image is transferred secondarily to the recording medium P. The recording medium P to which an image has been transferred secondarily passes through a fixing apparatus 80 comprising a heat roller 81 that provides heat from inside and a pressure roller 82 that is provided with an elastic member such as rubber or the like outside. A thermoplastic resin in the full-color image is dissolved and pressurized to be fixed on the recording medium P, thereby obtaining a desired image. The recording medium P on which an image is fixed is ejected by means of a paper ejection roller 74 from the printer main body.

EXAMPLES

Now, the present invention will be described with reference to examples. However, the present invention is not limited to these examples.

The synthesis examples of the fluorinated alkyl group-containing (meth)acrylates used in the respective examples described later are as follows:

Synthesis Example 1

First, 33.5 g of trimethylolpropane, 123.0 g of 3-perfluorooctyl propionate (made by TOSOH F-TECH INC.), 50 g of toluene and 50 g of cyclohexane were put in a 500 ml four-neck flask. Subsequently, 2.5 g of concentrated sulfuric acid was added thereto, and the mixture was dehydrated azeotropically for 12 hours. After having confirmed that 4.5 g of water was produced, the mixture was once cooled to 25° C., 45.0 g of acrylic acid and 0.4 g of hydroquinone were added thereto, and the mixture was dehydrated azeotropically with injecting air. After having confirmed that 9.0 g of water was produced, the mixture was cooled to 25° C. After having added 150 g of toluene to the reaction liquid and washed the reaction liquid so as to be neutral with 30 g of aqueous solution of 25% sodium hydroxide, the reaction liquid was washed further three times with 40 g of 20% by mass saline solution. Under reduced pressure, toluene and cyclohexane were distilled away, obtaining 170 g of slightly-yellow liquid. The slightly-yellow liquid was dissolved in 150 ml of toluene, and purification was performed by means of silica gel chromatography. Subsequently, under reduced pressure, toluene was distilled away at a water bath temperature of less than or equal to 50° C. with injecting oxygen, thereby obtaining a fluorinated alkyl group-containing acrylate (compound A-1) represented by the above-described structural formula (ii).

Synthesis Example 2

First, 15.7 g (0.03 mol) of dipentaerythritol hydroxypentaacrylate, 2 g of triethylamine and 10 g of ethyl acetate were put in a 200 ml reaction flask, and under agitation, 28.8 g (0.06 mol) of perfluorooctylethylmercaptane was added gradually (the reaction temperature has risen up to 35° C.). After the addition, agitation was performed at 50° C. further for three hours. After the end of agitation, 60 g of ethyl acetate was added, and then an organic layer was washed with 100 ml of 1 normal hydrochloric acid. After having washed the reaction liquid with 100 ml of water further two times, the organic layer was isolated preparatively. After having been distilled away under reduced pressure by means of an evaporator in a condition of less than or equal to 50° C., the reaction solvent was further dried by means of a vacuum pump, thereby obtaining a fluorinated alkyl group-containing acrylate (compound A-2) represented by the above-described structural formula (xviii).

Synthesis Example 3

First, 21.2 g (0.05 mol) of tris(acryloxyethyl) isocyanurate (Aronix M-315 made by TOAGOSEI CO., LTD.), 1.0 g of triethylamine and 15 g of ethyl acetate were put in a 200-ml reaction flask, and then 19.0 g (0.05 mol) of perfluorohexylethylmercaptane was dropped with being agitated at room temperature (the reaction temperature has risen up to 35° C.). Subsequently, agitation was performed at 50° C. further for three hours, and under reduced pressure at less than or equal to 50° C., ethyl acetate and triethylamine were distilled away, thereby obtaining a fluorinated alkyl group-containing acrylate (compound A-3) represented by the above-described structural formula (xxvi).

Synthesis Example 4

A fluorinated alkyl group-containing acrylate (compound A-4) represented by the above-described structural formula (xxx) was obtained similarly to Synthesis Example 3 except that 21.2 g (0.05 mol) of tris(acryloxyethyl) isocyanurate (Aronix M-315 made by TOAGOSEI CO., LTD.) was replaced with 15.1 g (0.05 mol) of EO-modified phosphoric acid triacrylate and that 19.0 g (0.05 mol) of perfluorohexylethylmercaptane was replaced with 24.0 g (0.05 mol) of perfluorooctylethylmercaptane.

The properties of the synthesized fluorinated alkyl group-containing acrylates are shown in Table 1.

TABLE 1

| Acrylate | Number of Acryloyl Groups | Fluorine Atom Content (% by mass) | Molecular Weight |
|---|---|---|---|
| A-1 | 2 | 45.1 | 546 |
| A-2 | 3 | 43.5 | 1142 |
| A-3 | 2 | 30.8 | 638 |
| A-4 | 2 | 39.2 | 656 |

Formation of Surface Protection Layers Comprising Fluorine Compounds

The method of measuring the fluorine atom contents of the surface protection layers formed by being coated with the respective samples and then dried is as follows: First, a 3 mm-square sample is cut from each of the surface protection layers. Then, a carbon tape is stretched on the sample stage of an electron microscope, and a sample is put on the carbon tape. The sample is moved into the electron microscope. As soon as a vacuum state ($5.0\times10^{-8}$ mmHg) is formed in the electron microscope by means of a vacuum pump, a cooling apparatus is also started (cooling water temperature: 5° C.). After the vacuum state has been formed in the electron microscope, an accelerating voltage of 5.0 kV is impressed to make the relative sensitivity of X-ray high, and the stage is moved to a range where an electronic image of the sample appears on the monitor. Subsequently, X-ray spectrum is analyzed by means of an energy dispersive X-ray analyzer E-MAX ENERUGY EX-220 (made by HORIBA, LTD.), thereby measuring the fluorine atom content.

Formation 1 of Surface Protection Layer

A PET-film having a thickness of 168 μm was spin coated with a perfluoro-solvent solution (solid concentration: 0.1% by mass) of a fluorine resin (5010 made by Fluoro Technology Co., Ltd.: Sample 1) and dried at 120° C. for 20 minutes, thereby forming a surface protection layer comprising a fluorine resin having a thickness of 0.3 μm.

Formation 2 of Surface Protection Layer

A surface protection layer comprising a fluorine resin was formed as described above except that the fluorine resin solution used in Formation 1 of Surface Protection Layer was replaced with a perfluoro-solvent solution (solid concentration: 1% by mass) of a fluorine resin (5040 made by Fluoro Technology Co., Ltd.: Sample 2).

Formation 3 of Surface Protection Layer

A surface protection layer comprising a fluorinated silicone oil was formed as described above except that the fluorine resin solution used in Formation 1 of Surface Protection Layer was replaced with a fluorinated silicone oil (FL-5 made by Shin-Etsu Chemical Co., Ltd.: Sample 3). Although, the surface protection layer comprising the fluorinated silicone oil was not solidified by means of dry heating, the measurement of a contact angle described later was made.

Formation 4 of Surface Protection Layer

A surface protection layer comprising a fluorinated silicone oil was formed as described above except that the fluorine resin solution used in Formation 1 of Surface Protection Layer was replaced with a fluorinated silicone oil (X-22-821 made by Shin-Etsu Chemical Co., Ltd.: Sample 4). The surface protection layer comprising the fluorinated silicone oil was not solidified by means of dry heating. However, the measurement of a contact angle described later was made.

Formation 5 of Surface Protection Layer

A surface protection layer comprising a fluorinated silicone oil was formed as described above except that the fluorine resin solution used in Formation 1 of Surface Protection Layer was replaced with a fluorinated silicone oil (X-22-822 made by Shin-Etsu Chemical Co., Ltd.: Sample 5). The surface protection layer comprising the fluorinated silicone oil was not solidified by means of dry heating. However, the measurement of a contact angle described later was made.

Formation 6 of Surface Protection Layer

A surface protection layer comprising a fluorinated silicone oil was formed as described above except that the fluorine resin solution used in Formation 1 of Surface Protection Layer was replaced with a fluorinated silicone oil (FL-100 made by Shin-Etsu Chemical Co., Ltd.: Sample 6). The surface protection layer comprising the fluorinated silicone oil was not solidified by means of dry heating. However, the measurement of a contact angle described later was made.

Formation 7 of Surface Protection Layer

A surface protection layer comprising a fluorine resin was formed as described above except that the fluorine resin solution used in Formation 1 of Surface Protection Layer was replaced with a tetrahydrofuran solution (solid concentration: 5% by mass) of a fluorine resin (MCF-350SF made by DAINIPPON INK AND CHEMICALS INC.: Sample 7).

Formation 8 of Surface Protection Layer

A surface protection layer comprising a fluorine resin was formed as described above except that the fluorine resin solution used in Formation 1 of Surface Protection Layer was replaced with a tetrahydrofuran solution (solid concentration: 5% by mass) of a fluorinated surface modifying agent (F-482 made by DAINIPPON INK AND CHEMICALS INC.: Sample 8).

Formation 9 of Surface Protection Layer

After having been spin coated with a tetrahydrofuran solution (solid concentration: 5% by mass) of a composition (Sample 9) comprising 70 parts by mass of the fluorinated alkyl group-containing (meth)acrylate (A-1) described in Table 1, 30 parts by mass of neopentylglycol diacrylate and 0.4 parts by mass of 2-hydroxy-2-methyl-1-phenylpropane-1-on, a PET-film having a thickness of 168 μm was put on a belt conveyor and was passed through an UV irradiation apparatus (TOSCURE 401 made by IRIE CORPORATION; irradiance level: 160 mJ/cm$^2$), thereby UV-curing the coating liquid containing Sample 9 to form a surface protection layer comprising a cured material of the fluorine-containing photo-curing composition having a thickness of 2 μm. The obtained surface protection layer had a fluorine atom content of 19.6% by mass.

Formation 10 of Surface Protection Layer

A surface protection layer comprising a cured material of the fluorine-containing photo-curing composition was formed as described above except that the composition used in Formation 9 of Surface Protection Layer was replaced with a tetrahydrofuran solution (solid concentration: 5% by mass) of a composition described below (Sample 10). The obtained surface protection layer had a fluorine atom content of 15.5% by mass.

60 parts by mass of the fluorinated alkyl group-containing (meth)acrylate (A-2) described in Table 1;

40 parts by mass of pentaerythritol tetraacrylate; and 4 parts by mass of 2-hydroxy-2-methyl-1-phenylpropane-1-on.

Formation 11 of Surface Protection Layer

A surface protection layer comprising a cured material of the fluorine-containing photo-curing composition was formed as described above except that the composition used in Formation 9 of Surface Protection Layer was replaced with a tetrahydrofuran solution (solid concentration: 5% by mass) of a composition described below (Sample 11). The obtained surface protection layer had a fluorine atom content of 8.8% by mass.

50 parts by mass of the fluorinated alkyl group-containing (meth)acrylate (A-3) described in Table 1;

50 parts by mass of trimethylolpropane triacrylate; and 4 parts by mass of 2-hydroxy-2-methyl-1-phenylpropane-1-on.

Formation 12 of Surface Protection Layer

A surface protection layer comprising a cured material of the fluorine-containing photo-curing composition was formed as described above except that the composition used in Formation 9 of Surface Protection Layer was replaced with a tetrahydrofuran solution (solid concentration: 5% by mass) of a composition described below (Sample 12). The obtained surface protection layer had a fluorine atom content of 11.2% by mass.

50 parts by mass of the fluorinated alkyl group-containing (meth)acrylate (A-4) described in Table 1;

50 parts by mass of trimethylolpropane triacrylate; and 4 parts by mass of 2-hydroxy-2-methyl-1-phenylpropane-1-on.

Formation 13 of Surface Protection Layer

A surface protection layer comprising a cured material of the fluorine-containing photo-curing composition was formed as described above except that the composition used in Formation 9 of Surface Protection Layer was replaced with a tetrahydrofuran solution (solid concentration: 5% by mass) of a composition described below (Sample 13). The obtained surface protection layer had a fluorine atom content of 8.3% by mass.

45 parts by mass of the fluorinated alkyl group-containing (meth)acrylate (A-3) described in Table 1;

5 parts by mass of fluorine resin fine particles ("LEBRON L5F" made by DAIKIN INDUSTRIES LTD., primary particle diameter: 0.2 μm);

50 parts by mass of trimethylolpropane triacrylate; and 4 parts by mass of 2-hydroxy-2-methyl-1-phenylpropane-1-on.

A 3 cm-square PET film on which a surface protection layer is formed is cut and used as a measurement sample. The contact angle of liquid paraffin (made by KANTO CHEMICAL CO., INC.; gravity: 0.875) and the contact angle of soybean oil (made by The Nisshin Oillio Group, Ltd.) on the measurement sample were measured by means of a contact angle measurement apparatus (DropMaster DM700 made by KYOWA INTERFACE SCIENCE CO., LTD.) under an environment of 25° C. and a humidity of 53%. The amount of a droplet at the time of measurements was 1 μL, and 100 ms-values and 5900 ms-values are measured. The results of the measurements are shown in Table 2:

TABLE 2

| | Liquid Paraffin | | Soybean Oil | |
|---|---|---|---|---|
| Sample | 100 ms-Value | 5900 ms-Value | 100 ms-Value | 5900 ms-Value |
| 1 | 65.2° | 62.6° | 75.1° | 73.2° |
| 2 | 48.1° | 45.0° | 57.9° | 52.8° |
| 3 | 32.3° | 29.7° | 38.0° | 27.5° |
| 4 | 33.3° | 30.1° | 40.3° | 23.5° |
| 5 | 36.2° | 33.0° | 45.1° | 37.7° |
| 6 | 41.6° | 38.3° | 47.9° | 34.6° |
| 7 | 76.1° | 73.0° | 84.8° | 83.7° |
| 8 | 95.6° | 91.8° | 104.1° | 73.0° |
| 9 | 62.8° | 60.1° | 71.3° | 68.8° |
| 10 | 60.4° | 57.1° | 68.9° | 67.3° |
| 11 | 60.0° | 57.0° | 67.6° | 65.2° |
| 12 | 58.1° | 55.2° | 63.9° | 63.1° |
| 13 | — | — | 68.1° | 67.5° |

The surface protection layers formed from the fluorine resins (Samples 1, 2 and 7), the surface protection layer formed from the fluorinated surface modifying agent (Sample 8) and the surface protection layers formed from the compositions (Samples 9 to 13) containing fluorinated alkyl groups-containing acrylates exhibited an excellent oil repellency.

Thus, soybean oil is dropped on each of the surface protection layers formed from Samples 1, 2 and 7 to 13 to measure the contact angles. Subsequently, the surfaces of these samples were cleaned by means of BEMCOT (made by ASAHI KASEI FIBERS CORPORATION) so as to leave no oil film. Then, a process of measuring the contact angles was repeated five times. The values of the fifth measurements are shown in Table 3.

TABLE 3

| | Liquid Paraffin | | Soybean Oil | |
|---|---|---|---|---|
| Sample | 100 ms-Value | 5900 ms-Value | 100 ms-Value | 5900 ms-Value |
| 1 | 55.3° | 44.9° | 63.3° | 51.9° |
| 2 | 40.3° | 36.2° | 50.3° | 45.2° |
| 7 | 65.2° | 54.6° | 72.1° | 58.6° |
| 8 | 80.2° | 56.9° | 69.2° | 42.6° |
| 9 | 61.8° | 60.0° | 71.0° | 68.7° |
| 10 | 59.5° | 56.9° | 68.5° | 65.0° |
| 11 | 59.1° | 58.8° | 67.3° | 67.0° |
| 12 | 58.0° | 55.4° | 63.7° | 63.0° |
| 13 | — | — | 68.0° | 67.0° |

The surface protection layers formed from the compositions (Samples 9 to 13) containing fluorinated alkyl groups-containing acrylates was affected little by the cleaning, and the oil repellency of the surface protection layers was deteriorated little by the cleaning.

The methods of manufacturing the liquid developing agents used in the present invention are as follows:

Preparation of Basic Treatment Pigment

A mixture of a polyester resin (PLASDIC DL-90 made by DAINIPPON INK AND CHEMICALS INC.) and a basic polymer dispersant (AJISPA PB-822 made by AJINOMONOTO-FINE-TECHNO CO., INC.) mixed at a ratio of 8:2 (mass ratio) was kneaded with a cyan pigment (phthalocynine pigment, Pigment Blue 15:3) at a ratio of 35 (cyan pigment):65 (mixture) (mass ratio) by means of a bead mill in methyl ethyl ketone. Subsequently, water was added to the kneaded material to precipitate a solid body. After the solvent had been removed, the solid body was dried and pulverized, thereby obtaining a basic treatment pigment.

Preparation of Cyan Liquid Developing Agent 150 g of soybean oil (made by The Nisshin Oillio Group, Ltd.; oleic acid content in triglyceride: 23.3% by mass); 50 g of oleic acid (made by KANTO CHEMICAL CO., INC.); 0.11 g of acidic dispersant (AJISPA PA111 made by AJINOMONOTO-FINE-TECHNO CO., INC.); and 35 g of the basic treatment pigment prepared as described above.

A composition comprising the above-described ingredients and 450 g of zirconia balls having a diameter of 3 mm respectively were put in a stainless steel container having a volume of 500 ml and mixed to be dispersed by means of an agitator at a rotation number of 504 rpm for 24 hours, thereby preparing a cyan liquid developing agent as a coloring agent dispersant.

The obtained cyan liquid developing agent had a toner concentration of 14.9% by mass, a viscosity (25°) of 990 mPa·s and an electric resistivity (25°) of $3.5\times10^{12}$ Ω·cm and contained colored fine particles having a primary particle diameter (number average particle diameter) of 1.1 μm.

Figure 4:
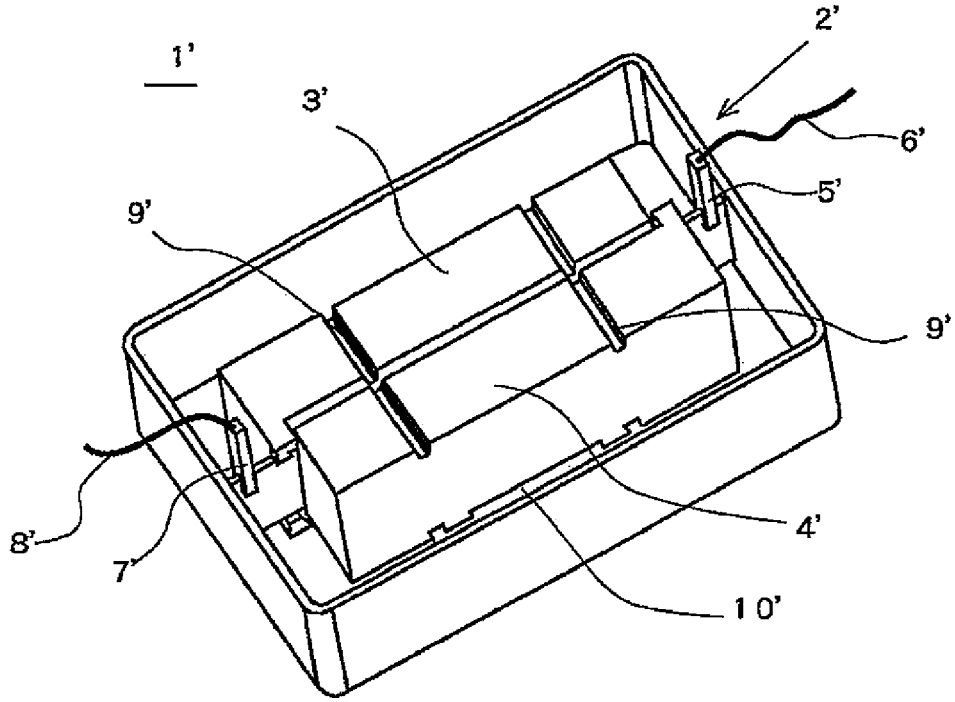
FIGS. 4A and 4B are views illustrating a cell used for measuring the adhesiveness of cyan coloring fine particles to an oil-repellent ITO-electrode.
Figure 4:
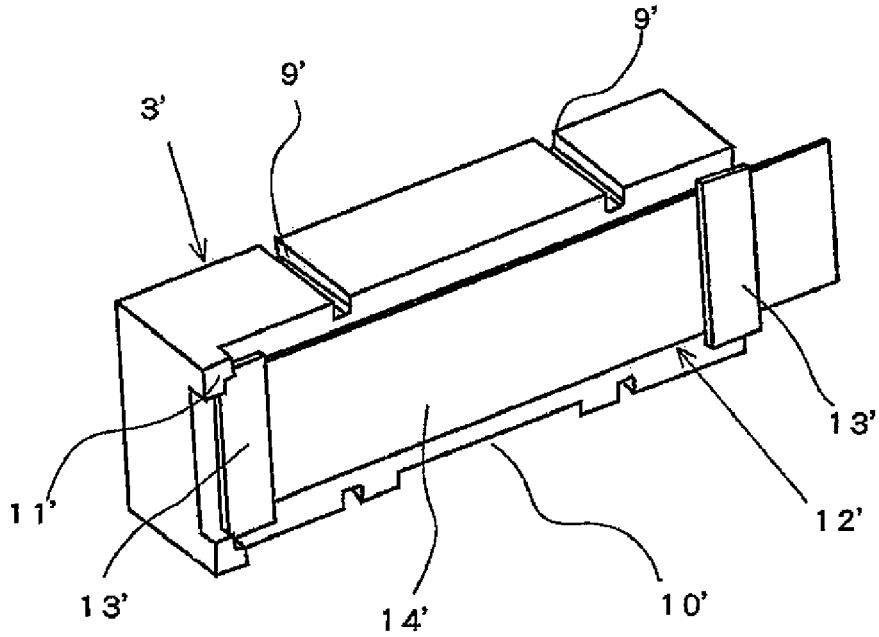

Adhesiveness Evaluation of Cyan Coloring Fine Particles to ITO Electrode Covered with Surface Protection Layer Formed from Fluorine Compound A surface protection layer of Sample 2 (soybean oil has a contact angle 100 ms-value of 57.9°), a surface protection layer of Sample 6 (soybean oil has a contact angle 100 ms-value of 47.9°), a surface protection layer of Sample 7 (soybean oil has a contact angle 100 ms-value of 84.8°) and a surface protection layer of Sample 12 (soybean oil has a contact angle 100 ms-value of 63.9°) were formed on ITO electrodes respectively to obtain oil-repellent ITO electrodes. Subsequently, the adhesiveness of the cyan liquid developing agent at 25° to the oil-repellent ITO electrodes was measured by means of an electrophoretic experiment device shown in FIG. 4.

FIG. 4A is a perspective view showing a measuring cell, and FIG. 4B is a perspective view illustrating an electrode section. The measuring cell 1' includes an anode side electrode section 3' and a cathode side electrode section 4' provided in a container 2' comprising an insulator material such as a glass, synthetic resin or the like. Moreover, a power feed anode side lead wire 6' coupled to a current supply device (not shown) is connected to an anode terminal 5' provided in the anode side electrode section 3', and a cathode side lead wire 8' coupled to a current supply device (not shown) is connected to a cathode terminal 7' provided in the cathode side electrode section 4'. The anode side electrode section 3' and cathode side electrode section 4' are provided with holding member mounting grooves 9' for holding both electrode sections with a predetermined distance between in the upper portions thereof respectively. The mounted holding members hold both electrode sections at a predetermined distance between during measurements. Moreover, the anode side electrode section 3' and cathode side electrode section 4' are provided with distribution grooves 10' for supplying pigment dispersing liquid smoothly in the lower portions thereof respectively.

Although, the electrode sections will be described with reference to the anode electrode section shown in FIG. 4B, the cathode electrode section has a similar structure and is formed from similar members. As the anode electrode section 3', there is used a molded body in which an anode engaging protrusion 11' is provided on a resin having a high oil and solvent resistance such as a polyacetal resin (POM) or the like. On the anode engaging protrusion 11', there is mounted an anode 12' together with a spacer 13' comprising an insulating member for maintaining the distance to a counter electrode constant. The anode 12' is an electrode in which an ITO transparent conducting film 14' is formed on a transparent glass plate, the ITO transparent conducting film 14' being not eluted by impressed current when current is impressed. By using an anode in which an ITO transparent conducting film 14' is formed on a transparent glass plate, the optical observations and measurements of a pigment precipitated on an anode detached from the anode electrode section are enabled to be performed easily after electrophoresis by means of energization of predetermined period.

Figure 5:
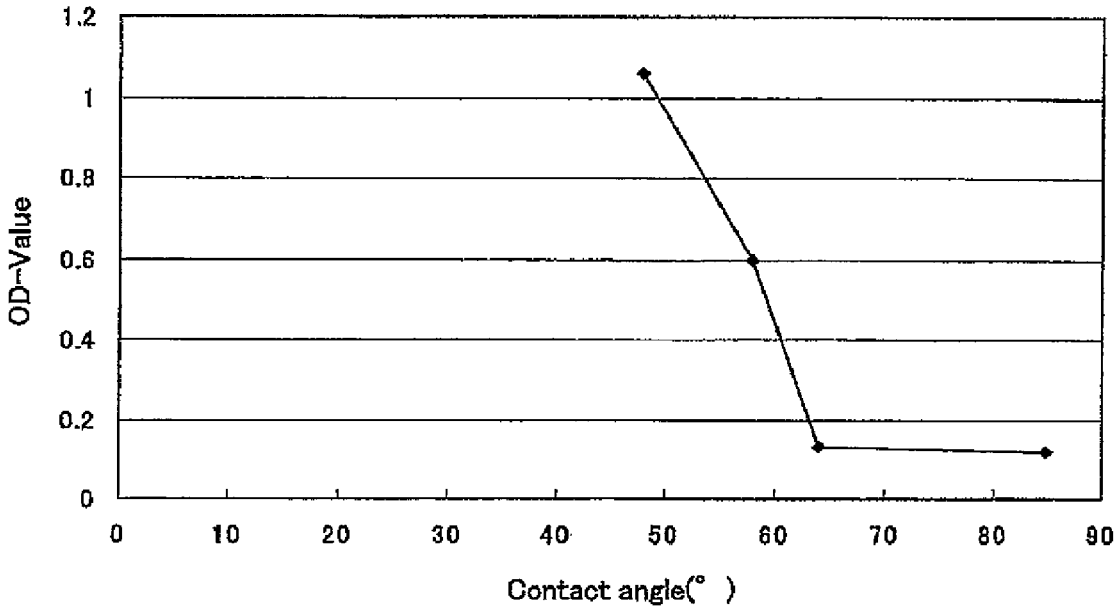
FIG. 5 is a graph illustrating the correlation of the concentration and contact angle of the cyan coloring fine particles adhered to the oil-repellent ITO-electrode.

With an oil repellent ITO electrode as the anode and with an ITO electrode having no coated surface as the cathode, direct current of 300 V was impressed on the electrophoretic experiment device for 10 seconds, and positively charged cyan coloring fine particles were electrophoresed to permit them to adhere to the oil repellent ITO electrode. The ITO electrode was detached from the measuring cell, and subsequently, the cyan coloring fine particles adhered to the respective electrodes were pressed on transfer paper (J-Paper made by FUJI XEROX OFFICE SUPPLY CO., LTD.) to be transferred, thereby obtaining colored solid images. The densities of the obtained solid images were measured as reflection densities by means of a reflection densitometer (Model 520-type Spectral Densitometer made by X-Rite Corporation) after one-day leaving. The higher the oil repellency (it was judged that the larger the contact angle was, the higher the oil repellency function was) was considered to be, the lower the reflection density (OD-value) of the colored solid image on the transfer paper was. The relation of the measured reflection densities (OD-values) and the contact angles is shown in FIG. 5. The liquid developing agents using soybean oil as carrier liquid were confirmed to adhere little to films having a contact angle of soybean oil of more than or equal to 60°.

Example 1

A photoconductor drum rotated at 120 rpm (made by KYOCERA Corporation, Ø40) was coated once with an isopropyl alcohol solution (solid content: 5% by mass) of Sample 9 by means of a spray coater made by ASAHI SUNAC CORPORATION). Subsequently, the photoconductor drum rotated at 120 rpm was irradiated with ultraviolet light at an irradiance level of 160 mJ/cm$^2$ by means of a cylindrical tube rotary drying ultraviolet irradiation device (NPT453 made by Nippon Bunkaseiko Co., LTD.), and the coating liquid was dried for 20 seconds, thereby fabricating a positively charged a-Si photoconductor drum on which a surface protection layer having a fluorine atom content of 19.6% by mass and a film thickness of 0.1 μm was formed.

Example 2

A photoconductor drum rotated at 120 rpm (made by KYOCERA Corporation, Ø40) was coated twice with an isopropyl alcohol solution (solid content: 5% by mass) of Sample 10 by means of a spray coater made by ASAHI SUNAC CORPORATION. Subsequently, the photoconductor drum rotated at 120 rpm was irradiated with ultraviolet light at an irradiance level of 160 mJ/cm$^2$ by means of a cylindrical tube rotary drying ultraviolet irradiation device (NPT453 made by Nippon Bunkaseiko Co., LTD.), and the coating liquid was dried for 20 seconds, thereby fabricating a positively charged a-Si photoconductor drum on which a surface protection layer having a fluorine atom content of 15.5% by mass and a film thickness of 1 μm was formed.

Example 3

A photoconductor drum rotated at 120 rpm (made by KYOCERA Corporation, Ø40) was coated twice with an isopropyl alcohol solution (solid content: 6% by mass) of Sample 11 by means of a spray coater made by ASAHI SUNAC CORPORATION. Subsequently, the photoconductor drum rotated at 120 rpm was irradiated with ultraviolet light at an irradiance level of 160 mJ/cm$^2$ by means of a cylindrical tube rotary drying ultraviolet irradiation device (NPT453 made by Nippon Bunkaseiko Co., LTD.), and the coating liquid was dried for 20 seconds, thereby fabricating a positively charged a-Si photoconductor drum on which a surface protection layer having a fluorine atom content of 8.8% by mass and a film thickness of 1.5 μm was formed.

Example 4

A photoconductor drum rotated at 120 rpm (made by KYOCERA Corporation, Ø40) was coated once with an isopropyl alcohol solution (solid content: 8% by mass) of Sample 12 by means of a spray coater made by ASAHI SUNAC CORPORATION. Subsequently, the photoconductor drum rotated at 120 rpm was irradiated with ultraviolet light at an irradiance level of 160 mJ/cm$^2$ by means of a cylindrical tube rotary drying ultraviolet irradiation device (NPT453 made by Nippon Bunkaseiko Co., LTD.), and the coating liquid was dried for 20 seconds, thereby fabricating a positively charged a-Si photoconductor drum on which a surface protection layer having a fluorine atom content of 11.2% by mass and a film thickness of 0.2 μm was formed.

Example 5

A photoconductor drum rotated at 120 rpm (made by KYOCERA Corporation, Ø40) was coated three times with an isopropyl alcohol solution (solid content: 10% by mass) of Sample 9 by means of a spray coater made by ASAHI SUNAC CORPORATION. Subsequently, the photoconductor drum rotated at 120 rpm was irradiated with ultraviolet light at an irradiance level of 160 mJ/cm$^2$ by means of a cylindrical tube rotary drying ultraviolet irradiation device (NPT453 made by Nippon Bunkaseiko Co., LTD.), and the coating liquid was dried for 20 seconds, thereby fabricating a positively charged a-Si photoconductor drum on which a surface protection layer having a fluorine atom content of 19.6% by mass and a film thickness of 2 μm was formed.

The half-reduced light exposure and light attenuation residual potential (potential after a light exposure of 1 μm/cm$^2$) of the positively charged a-Si photoconductor drums (Examples 1 to 5) and a positively charged a-Si photoconductor drum on which no surface protection layer was formed (Comparative Example 1) were obtained based upon the light attenuation curve described below.

Using a drum tester (PDT-2000LTM made by QEA Corporation), a process speed of 206 m/min, an impressed voltage of 5.2 kV and a surface potential of 600 V were set, drawing a light attenuation curve by performing charge light exposure.

The results are shown in Table 4. In Table 4, there are also shown the 5900 ms-values of the contact angles of canola oil, sunflower oil and safflower oil on the positively charged a-Si photoconductor drums.

TABLE 4

| | Half-reduced Light Exposure (μJ/cm$^2$) | Light Attenuation Residual Potential (V) | Contact Angle | | |
|---|---|---|---|---|---|
| | | | Canola Oil | Sunflower Oil | Safflower Oil |
| Example 1 | 0.32 | 86 | 54.2° | 54.1° | 54.2° |
| Example 2 | 0.39 | 100 | 65.3° | 64.9° | 65.1° |
| Example 3 | 0.42 | 125 | 68.6° | 68.2° | 68.5° |
| Example 4 | 0.45 | 95 | 59.8° | 59.6° | 60.0° |
| Example 5 | 0.33 | 150 | 70.0° | 69.5° | 70.0° |
| Comp. Ex. 1 | 0.31 | 80 | 32.3° | 32.1° | 32.0° |

The a-Si photoconductor drum coated with a surface protection layer comprising the cured material of the fluorine-containing ultraviolet curing composition exhibited a little lower photosensitivity. However, the a-Si photoconductor drums having a surface protection layer thickness of 0.1 to 1.5 μm exhibited a practically sufficient photosensitivity. On the other hand, the contact angles of the vegetable oils on the a-Si photoconductor drum having a surface protection layer thickness of 0.1 μm were smaller than the contact angles of the vegetable oils on the a-Si photoconductor drums having a surface protection layer thickness of 0.2 to 1.5 μm. Further, the contact angles of canola oil, sunflower oil and safflower oil on the surface protection layers of the a-Si photoconductor drums exhibited values similar to the contact angles of soybean oil on the surface protection layers of the a-Si photoconductor drums.

Fabrication of Positively Charged Organic Photoconductor Drum

A composition comprising the ingredients described below was mixed to be dispersed for 10 hours in a paint condition, thereby preparing a coating liquid:

21 parts by mass of a polycarbonate resin (TS-2020 made by TEIJIN CHEMICALS LTD.);

2 parts by mass of metal-free phthalocyanine (made by DAINIPPON INK AND CHEMICALS INC.);

10 parts by mass of a hydrazone compound (made by ANAN Corporation);

5 parts by mass of 3,5-dimethyl-3',5'-di(t)butyl-4,4'-diphenoquinone; and 180 parts by mass of toluene.

An untreated Ø40 mm aluminum tube was coated with the obtained photoconductive layer forming coating liquid by means of ring coat method and then dried, thereby fabricating an organic photoconductor drum on which a photoconductive layer having a film thickness of 20 μm was formed.

Example 6

Silica (OX-50 made by JAPAN AEROSIL CO., LTD.) was added to a methyl cellosolve solution of Sample 9 so as to have a solid concentration of 50 by mass, thereby preparing a coating liquid having an overall solid content of 15% by mass. An organic photoconductor drum rotated at 120 rpm was coated three times with the coating liquid by the spray coater made by ASAHI SUNAC CORPORATION. Subsequently, the organic photoconductor drum rotated at 120 rpm was irradiated with ultraviolet light at an irradiance level of 160 mJ/cm$^2$ by means of a cylindrical tube rotary drying ultraviolet irradiation device (NPT453 made by Nippon Bunkaseiko Co., LTD.), and the coating liquid was dried for 20 seconds, thereby fabricating an organic photoconductor drum on which a surface protection layer having a fluorine atom content of 19.6% by mass, a film thickness of 4 μm and a surface resistivity of $3.6\times10^{13}$ Ω·cm was formed.

Example 7

A coating liquid comprising a methyl cellosolve solution of Sample 10 (solid concentration: 5% by mass) was prepared. An organic photoconductor drum rotated at 120 rpm was coated twice with the coating liquid by the spray coater made by ASAHI SUNAC CORPORATION. Subsequently, the organic photoconductor drum rotated at 120 rpm was irradiated with ultraviolet light at an irradiance level of 160 mJ/cm$^2$ by means of a cylindrical tube rotary drying ultraviolet irradiation device (NPT453 made by Nippon Bunkaseiko Co., LTD.), and the coating liquid was dried for 20 seconds, thereby fabricating an organic photoconductor drum on which a surface protection layer having a fluorine atom content of 15.5% by mass, a film thickness of 1 μm and a surface resistivity of $1.1\times10^{15}$ Ω·cm was formed.

Example 8

Silica (OX-50 made by JAPAN AEROSIL CO., LTD.) was added to a methyl cellosolve solution of Sample 11 so as to have a solid concentration of 5% by mass, thereby preparing a coating liquid having an overall solid content of 10% by mass. An organic photoconductor drum rotated at 120 rpm was coated four times with the coating liquid by the spray coater made by ASAHI SUNAC CORPORATION. Subsequently, the organic photoconductor drum rotated at 120 rpm was irradiated with ultraviolet light at an irradiance level of 160 mJ/cm$^2$ by means of a cylindrical tube rotary drying ultraviolet irradiation device (NPT453 made by Nippon Bunkaseiko Co., LTD.), and the coating liquid was dried for 20 seconds, thereby fabricating an organic photoconductor drum on which a surface protection layer having a fluorine atom content of 8.8% by mass, a film thickness of 2 μm and a surface resistivity of $2.8\times10^{15}$ Ω·cm was formed.

Example 9

A coating liquid comprising a methyl cellosolve solution of Sample 13 (solid concentration: 5% by mass) was prepared. An organic photoconductor drum rotated at 120 rpm was coated four times with the coating liquid by the spray coater made by ASAHI SUNAC CORPORATION. Subsequently, the organic photoconductor drum rotated at 120 rpm was irradiated with ultraviolet light at an irradiance level of 160 mJ/cm$^2$ by means of a cylindrical tube rotary drying ultraviolet irradiation device (NPT453 made by Nippon Bunkaseiko Co., LTD.), and the coating liquid was dried for 20 seconds, thereby fabricating an organic photoconductor drum on which a surface protection layer having a fluorine atom content of 8.3% by mass, a film thickness of 2 μm and a surface resistivity of $2.6\times10^{15}$ Ω·cm was formed.

Example 10

A coating liquid comprising a methyl cellosolve solution of Sample 12 (solid concentration: 5% by mass) was prepared. An organic photoconductor drum rotated at 120 rpm was coated once with the coating liquid by the spray coater made by ASAHI SUNAC CORPORATION. Subsequently, the organic photoconductor drum rotated at 120 rpm was irradiated with ultraviolet light at an irradiance level of 160 mJ/cm$^2$ by means of a cylindrical tube rotary drying ultraviolet irradiation device (NPT453 made by Nippon Bunkaseiko Co., LTD.), and the coating liquid was dried for 20 seconds, thereby fabricating an organic photoconductor drum on which a surface protection layer having a fluorine atom content of 11.2% by mass, a film thickness of 0.1 μm and a surface resistivity of $1.6\times10^{15}$ Ω·cm was formed.

Example 11

Silica (OX-50 made by JAPAN AEROSIL CO., LTD.) was added to a methyl cellosolve solution of Sample 9 so as to have a solid concentration of 5% by mass, thereby preparing a coating liquid having an overall solid content of 10% by mass. An organic photoconductor drum rotated at 120 rpm was coated four times with the coating liquid by the spray coater made by ASAHI SUNAC CORPORATION. Subsequently, the organic photoconductor drum rotated at 120 rpm was irradiated with ultraviolet light at an irradiance level of 160 mJ/cm$^2$ by means of a cylindrical tube rotary drying ultraviolet irradiation device (NPT453 made by Nippon Bunkaseiko Co., LTD.), and the coating liquid was dried for 20 seconds, thereby fabricating an organic photoconductor drum on which a surface protection layer having a fluorine atom content of 18.7% by mass, a film thickness of 3 μm and a surface resistivity of $3.1\times10^{13}$ Ω·cm was formed.

The half-reduced light exposure and light attenuation residual potential (potential after a light exposure of 1 μJ/cm$^2$) of the organic photoconductor drums (Examples 6 to 11) and an organic photoconductor drum on which no surface protection layer was formed (Comparative Example 2) were obtained based upon the light attenuation curve described below.

The results are shown in Table 5. In Table 5, there are also shown the 5900 ms-values of the contact angles of canola oil, sunflower oil and safflower oil on the organic photoconductor drums.

TABLE 5

| | Half-reduced Light Exposure (μJ/cm$^2$) | Light Attenuation Residual Potential (V) | Contact Angle | | |
|---|---|---|---|---|---|
| | | | Canola Oil | Sunflower Oil | Safflower Oil |
| Example 6 | 0.18 | 200 | 71.3° | 71.4° | 71.2° |
| Example 7 | 0.16 | 120 | 67.8° | 67.9° | 67.8° |
| Example 8 | 0.16 | 120 | 68.4° | 68.5° | 68.4° |
| Example 9 | 0.16 | 125 | 69.3° | 69.4° | 69.4° |
| Example 10 | 0.15 | 130 | 61.1° | 61.3° | 61.0° |
| Example 11 | 0.17 | 150 | 70.1° | 70.2° | 70.0° |
| Comp. Ex. 2 | 0.15 | 110 | 34.0° | 34.1° | 34.0° |

The organic photoconductor drum coated with a surface protection layer comprising the cured material of the fluorine-containing ultraviolet curing composition exhibited a little lower photosensitivity. However, the organic photoconductor drums having a surface protection layer thickness of 0.1 to 3 μm exhibited a practically sufficient photosensitivity. Further, the contact angles of canola oil, sunflower oil and safflower oil on the surface protection layers of the organic photoconductor drums exhibited values similar to the contact angles of soybean oil on the surface protection layers of the organic photoconductor drums.

Comparative Example 3

A composition comprising the following ingredients (Sample 14) was prepared:

25 parts by mass of the fluorinated alkyl group-containing (meth)acrylate (A-3) described in Table 1;

75 parts by mass of neopentylglycol diacrylate; and 0.2 parts by mass of 2-hydroxy-2-methyl-1-phenylpropane-1-on.

Silica (OX-50 made by JAPAN AEROSIL CO., LTD.) was added to a methyl cellosolve solution of Sample 14 so as to have a solid concentration of 5% by mass, thereby preparing a coating liquid having an overall solid content of 15% by mass. The above-described a-Si photoconductor drum rotated at 120 rpm was coated three times with the coating liquid by the spray coater made by ASAHI SUNAC CORPORATION. Subsequently, the a-Si photoconductor drum rotated at 120 rpm was irradiated with ultraviolet light at an irradiance level of 160 mJ/cm$^2$ by means of a cylindrical tube rotary drying ultraviolet irradiation device (NPT453 made by Nippon Bunkaseiko Co., LTD.), and the coating liquid was dried for 20 seconds, thereby fabricating an a-Si photoconductor drum on which a surface protection layer having a fluorine atom content of 5.8% by mass was formed.

Comparative Example 4

A composition comprising the following ingredients (Sample 15) was prepared:

70 parts by mass of the fluorinated alkyl group-containing (meth)acrylate (A-1) described in Table 1;

30 parts by mass of neopentylglycol diacrylate; and 4 parts by mass of 2-hydroxy-2-methyl-1-phenylpropane-1-on.

Silica (OX-50 made by JAPAN AEROSIL CO., LTD.) was added to a methyl cellosolve solution of Sample 15 so as to have a solid concentration of 5% by mass, thereby preparing a coating liquid having an overall solid content of 15% by mass. The above-described a-Si photoconductor drum rotated at 120 rpm was coated three times with the coating liquid by the spray coater made by ASAHI SUNAC CORPORATION. Subsequently, the a-Si photoconductor drum rotated at 120 rpm was irradiated with ultraviolet light at an irradiance level of 160 mJ/cm$^2$ by means of a cylindrical tube rotary drying ultraviolet irradiation device (NPT453 made by Nippon Bunkaseiko Co., LTD.), and the coating liquid was dried for 20 seconds, thereby fabricating an a-Si photoconductor drum on which a surface protection layer having a fluorine atom content of 25.6% by mass was formed.

Comparative Example 5

Same operations as in Comparative Example 3 were performed except that the a-Si photoconductor drum used in Comparative Example 3 was replaced with an organic photoconductor drum, thereby fabricating an organic photoconductor drum on which a surface protection layer having a fluorine atom content of 5.8% by mass was formed.

Comparative Example 6

Same operations as in Comparative Example 4 were performed except that the a-Si photoconductor drum used in Comparative Example 4 was replaced with an organic photoconductor drum, thereby fabricating an organic photoconductor drum on which a surface protection layer having a fluorine atom content of 25.6% by mass was formed.

Preparation of Magenta, Yellow and Black Liquid Developing Agents

In the above-described preparation of a cyan liquid developing agent, the phthalocyanine pigment was replaced with magenta Pigment Red 57:1, yellow Pigment Yellow 74 and carbon black (particle diameter: 40 nm; nitrogen adsorption specific surface area: 55 m$^2$/g) to prepare basic treatment pigments corresponding to the three colors. Subsequently, the respective basic treatment pigments were used to prepare liquid developing agents of the respective colors.

Printing Test by Means of Liquid Developing Tandem Printer Incorporating a-Si Photoconductor Drum The liquid developing agents of the respective colors prepared as describe above (carrier liquid: soybean oil or liquid paraffin) were stored in developing containers of a liquid developing tandem printer shown in FIG. 3, the tandem printer incorporating the a-Si photoconductor drums of Examples 1 to 4 and Comparative Examples 1, 3 and 4. Using a printing pattern that includes a color image using each of the colors for each 5% thereof, printing test (recording medium: 1000 sheets) was performed. The amounts of the liquid developing agents cleaned off from the respective photoconductors are shown in Table 6.

The printing test was performed under the following conditions:

Process speed: 206 m/min

Impressed voltage: 6 kV

Developing bias: 350 V

Toner layer thickness on a developing roller: 10 μm

Primary transfer voltage: 650 V

Secondary transfer voltage: 1.1 kV

Recording medium: EP-L Fine Enamel Paper 81.4 gsm made by MITSUBISHI PAPER MILLS LTD.

Fuser roller temperature: 120° C.

TABLE 6

| | Liquid | Amounts of Cleaned-Off Liquid Developing Agents (g) | |
|---|---|---|---|
| | Developing Agent | Soybean Oil Carrier | Liquid Paraffin Carrier |
| Example 1 | Cyan | 32.7 | 45.2 |
| Example 2 | Magenta | 3.9 | 6.3 |
| Example 3 | Yellow | 3.1 | 5.9 |
| Example 4 | Black | 8.2 | 11.4 |
| Comp. Ex. 1 | Cyan | 80.1 | 86.3 |
| Comp. Ex. 3 | Cyan | 64.7 | — |
| Comp. Ex. 4 | Cyan | 1.6 | — |

The amounts of the liquid developing agents adhered to the a-Si photoconductor drums of Examples 1 to 4 were considerably smaller than the amounts of the liquid developing agents adhered to the a-Si photoconductor drum of Comparative Example 1 where no surface protection layer was formed and the a-Si photoconductor drum of Comparative Example 3 where a surface protection layer having a fluorine atom content of less than 8.5% by mass was formed respectively. Therefore, the liquid developing agents are considered to be unlikely to adhere to the non-image areas of the a-Si photoconductor drums comprising an cured material of a fluorine-containing ultraviolet curing composition where a surface protection layer having a fluorine atom content of more than or equal to 8.5% by mass was formed.

Fog measurements were performed on the first and second sheets of a printed matter printed by means of a tandem printer incorporating the a-Si photoconductors of Examples 1 to 4 by means of a reflection densitometer (Model 520-type Spectral Densitometer made by X-Rite Corporation). Both of the first and second sheets of the printed matter exhibited a reflection density of 0.11 corresponding to the reflection density of the transfer body, and no fog was confirmed. On the other hand, the fog area of a printed matter printed by means of a tandem printer incorporating the a-Si photoconductor drum of Comparative Example 1 where no surface protection layer was formed exhibited a reflection density of 0.19, and fog was confirmed.

On the other hand, the first and fifth sheets of a printed matter printed by means of a tandem printer incorporating the a-Si photoconductor drum of Comparative Example 3 exhibited reflection densities of 0.09 and 0.12 respectively. However, the sixth sheet thereof exhibited a reflection density of 0.19, and fog was confirmed. Therefore, the non-image area of the a-Si photoconductor drum where a surface protection layer having a fluorine atom content of less than 8.5% by mass was formed exhibited insufficient oil repellency.

Image deletion was confirmed not only on the first sheet of a printed matter printed by means of a tandem printer incorporating the a-Si photoconductor drum of Comparative Example 4, but also on the 1000th sheet thereof. Since the a-Si photoconductor drum where a surface protection layer having a fluorine atom content of more than 20% by mass was formed exhibited too high oil repellency, the a-Si photoconductor drum caused image deletion.

Printing Test by Means of Liquid Developing Tandem Printer Incorporating Organic Photoconductor Drum The liquid developing agents of the respective colors prepared as described above (carrier liquid: soybean oil) were stored in developing containers of a liquid developing tandem printer shown in FIG. 3, the tandem printer incorporating the organic photoconductor drums of Examples 6 to 11 and Comparative Examples 2, 5 and 6. Using a printing pattern that includes a color image using each of the colors for each 5% thereof, printing test (recording medium: 1000 sheets) was performed. The amounts of the liquid developing agents cleaned off from the respective photoconductors are shown in Table 7.

The printing test was performed under the following conditions:

Process speed: 206 m/min
Impressed voltage: 5.5 kV
Developing bias: 350 V
Toner layer thickness on a developing roller: 10 μm
Primary transfer voltage: 650 V
Secondary transfer voltage: 1.1 kV
Recording medium: EP-L Fine Enamel Paper 81.4 gsm made by MITSUBISHI PAPER MILLS LTD.
Fuser roller temperature: 120° C.

TABLE 7

| | Liquid Developing Agent | Amounts of Cleaned-Off Liquid Developing Agents (g) |
|---|---|---|
| Example 7 | Cyan | 3.9 |
| Example 8 | Magenta | 3.5 |
| Example 9 | Magenta | 3.0 |
| Example 10 | Yellow | 4.6 |
| Example 11 | Black | 2.8 |

TABLE 7-continued

| | Liquid Developing Agent | Amounts of Cleaned-Off Liquid Developing Agents (g) |
|---|---|---|
| Comp. Ex. 2 | Cyan | 81.7 |
| Comp. Ex. 5 | Cyan | 64.7 |
| Comp. Ex. 6 | Cyan | 1.6 |

The amounts of the liquid developing agents adhered to the organic photoconductor drums of Examples 6 to 11 were considerably smaller than the amounts of the liquid developing agents adhered to the organic photoconductor drum of Comparative Example 2 where no surface protection layer was formed and the organic photoconductor drum of Comparative Example 5 where a surface protection layer having a fluorine atom content of less than 8.5% by mass was formed, respectively. Therefore, the liquid developing agents are considered to be unlikely to adhere to the non-image areas of the organic photoconductor drums comprising an cured material of a fluorine-containing ultraviolet curing composition where a surface protection layer having a fluorine atom content of more than or equal to 8.5% by mass is formed. Further, comparing the organic photoconductor drum of Example 8 with the organic photoconductor drum of Example 9, the organic photoconductor drum of Example 9 containing fluorine resin fine particles was confirmed to exhibit better oil repellency, thereby reducing the amount of cleaning toner.

On the other hand, the first and fifth sheets of a printed matter printed by means of a tandem printer incorporating the organic photoconductor drum of Comparative Example 5 exhibited reflection densities of 0.09 and 0.12 respectively. However, the sixth sheet thereof exhibited a reflection density of 0.19, and fog was confirmed. Therefore, the non-image area of the organic photoconductor drum where a surface protection layer having a fluorine atom content of less than 8.5% by mass was formed exhibited insufficient oil repellency.

Image deletion was confirmed not only on the first sheet of a printed matter printed by means of a tandem printer incorporating the organic photoconductor drum of Comparative Example 6, but also on the 1000th sheet thereof. Since the organic photoconductor drum where a surface protection layer having a fluorine atom content of more than 20% by mass was formed exhibited too high oil repellency, the organic photoconductor drum caused image deletion.

What is claimed is:

1. A photoconductor coated with a surface protection layer comprising a cured material of a fluorine-containing photocuring composition containing fluorinated alkyl group-containing (meth)acrylate and a photopolymerization initiator, the surface protection layer having a fluorine atom content of 8.5 to 20% by mass.

2. The photoconductor according to claim 1, wherein the fluorinated alkyl group-containing (meth)acrylate is represented by the following general formula (1):

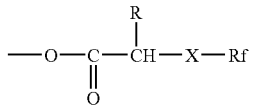

(1)

[wherein R is a hydrogen atom or an alkyl group having 1 to 4 carbon(s), and X is an alkylene chain that may have hetero atoms or a linkage group represented by the following general formula (2):

(2)

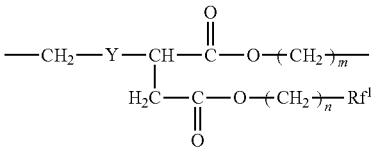

(wherein Y is an oxygen atom or a sulfur atom, m and n are integers of 1 to 4 that may be identical or different, and $Rf^1$ is a fluorinated alkyl group), and Rf is a fluorinated alkyl group].

3. The photoconductor according to claim 2, wherein X in the general formula (1) is an alkylene group represented by the following general formula (3):

$$—(CH_2)_p—Z_q—(CH_2)_r— \quad (3)$$

[wherein Z is NR (R is a hydrogen atom or an alkyl group having 1 to 24 carbon(s)), an oxygen atom, a sulfur atom or NR—$SO_2$ (R is a hydrogen atom or an alkyl group having 1 to 24 carbon(s)), p is an integer of 0 to 4, q is 0 or 1, r is an integer of 0 to 20, and $1 \leqq p+r \leqq 20$].

4. The photoconductor according to claim 2, wherein X in the general formula (1) is a linkage group represented by the general formula (2) [wherein $Rf^1$ is $C_nF_{2n+1}$ (n is an integer of 1 to 20)] or an alkylene chain represented by the general formula (3) [wherein Z is NR (R is a hydrogen atom or an alkyl group having 1 to 24 carbon(s)), an oxygen atom, a sulfur atom or NR—$SO_2$ (R is a hydrogen atom or an alkyl group having 1 to 24 carbon(s)), p is 1, q is 1, and r is an integer of 0 to 19], and further Rf in the general formula (1) is $C_nF_{2n+1}$ that is identical with or different from $Rf^1$ (n is an integer of 1 to 20).

5. The photoconductor according to claim 2, wherein X in the general formula (1) is a linkage group represented by the general formula (2) [wherein Y is a sulfur atom and the carbon number n of $Rf^1$ is 4, 6 or 8] or an alkylene chain represented by the general formula (3) [wherein Z is NR (R is a hydrogen atom or an alkyl group having 1 to 6 carbon(s)), a sulfur atom or NR—$SO_2$ (R is an alkyl group having 1 to 6 carbon(s))], and further the number of carbons n of Rf in the general formula (1) is 4, 6 or 8.

6. The photoconductor according to claim 2, wherein the fluorinated alkyl-containing (meth)acrylate is a compound obtained by subjecting a compound (a1) having more than or equal to three (meth)acryloyl groups to a Michael-addition reaction with a compound represented by the following formula (4):

$$Rf—(CH_2)_r—Z—H \quad (4)$$

[wherein r is an integer of 0 to 20, and Rf is $C_nF_{2n+1}$ (n is an integer of 1 to 20), and Z is NR (R is a hydrogen atom or an alkyl group having 1 to 24 carbon(s)), an oxygen atom, a sulfur atom or NR—$SO_2$ (R is a hydrogen atom or an alkyl group having 1 to 24 carbon(s))], or a compound (a2) represented by the following general formula (5):

(5)

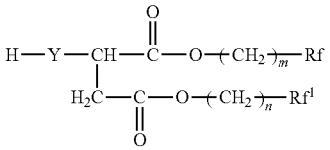

[wherein Y is an oxygen atom or a sulfur atom, m and n are integers of 1 to 4 that may be identical or different, and Rf and $Rf^1$ are $C_nF_{2n+1}$ (n is an integer of 1 to 20) that may be identical or different] at a ratio of 1 mol of the compound (a1) to 1.0 to (k-2) mol of the compound (a2) [wherein k is an average number of (meth)acryloyl groups in one molecule of the compound (a1)].

7. The photoconductor according to claim 6, wherein the compound (a2) is a compound represented by the general formula (4) [wherein Z is NR (R is a hydrogen atom or an alkyl group having 1 to 6 carbon(s)), a sulfur atom or NR—$SO_2$ (R is an alkyl group having 1 to 6 carbon(s)), and the number of carbons n in Rf is 4, 6 or 8], or a compound represented by the general formula (5) [wherein Y is a sulfur atom and the respective numbers of carbons n in Rf and $Rf^1$ are 4, 6 or 8].

8. The photoconductor according to claim 6, wherein the compound (a1) having more than or equal to three (meth) acryloyl groups is a compound (a1-1) represented by the following general formula (6):

(6)

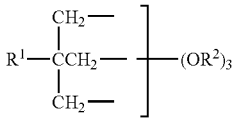

[wherein $R^1$ is a hydroxyl group, an alkyl group having 1 to 24 carbon(s), an alkylcarbonyloxy group having 1 to 24 carbon(s), $CH_2{=}CHCO_2CH_2$—, $CH_2{=}C(CH_3)CO_2CH_2$—, a (poly)oxyalkylene group having a number of cycles of more than or equal to 1 and closed at the terminal thereof by a hydrogen atom or an alkyl group having 1 to 18 carbon(s), or an alkylol group having 1 to 12 carbon(s), and $R^2$ is a (meth) acryloyl group], a compound (a1-2) represented by the following general formula (7):

(7)

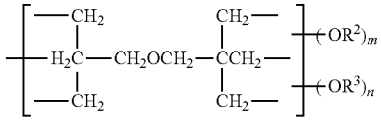

[wherein $R^2$ is a (meth)acryloyl group, $R^3$ is a hydrogen atom or an alkylcarbonyl group having 1 to 18 carbon(s), m is an integer of 3 to 6, n is an integer of 0 to 3, and further m+n=6], urethane (meth)acrylate (a1-3), cyanurate ring-containing tri (meth)acrylate (a1-4), or tri(meth)acrylate phosphate (a1-5).

9. The photoconductor according to claim 6, wherein the compound (a1) having more than or equal to three (meth) acryloyl groups is a compound represented by the general formula (6) [wherein $R^1$ is a straight-chain alkyl group having 1 to 4 carbon(s), $CH_2{=}CHCO_2CH_2$—, $CH_2{=}C(CH_3)CO_2CH_2$—, or an alkylol group having 1 to 3 carbon(s)], a compound represented by the general formula (7) [wherein $R^3$ is a hydrogen atom or an alkylcarbonyl group having 1 to 12 carbon(s)] or urethane (meth)acrylate obtained by allowing hydroxyl group-containing (meth)acrylate having more than or equal to two (meth)acryloyl groups to react with isocyanate compounds having an alicyclic structure.

10. The photoconductor according to claim 1, wherein the contact angle of soybean oil on the surface protection layer of the photoconductor is 60° to 90°.

11. The photoconductor according to claim 1, wherein the photoconductor is used for a liquid developing system.

12. The photoconductor according to claim 1, wherein the photoconductor is an amorphous silicon photoconductor.

13. The photoconductor according to claim 12, wherein the surface protection layer of the amorphous silicon photoconductor has a thickness of 0.2 to 1.5 μm.

14. The photoconductor according to claim 1, wherein the photoconductor is an organic photoconductor.

15. The photoconductor according to claim 14, wherein the binder of the organic photoconductive layer of the organic photoconductor is a polycarbonate resin and positively chargeable.

16. The photoconductor according to claim 14, wherein the surface protection layer of the organic photoconductor has a thickness of 0.1 to 3 μm.

17. The photoconductor according to claim 1, wherein the fluorine-containing photo-curing composition contains fluorine resin fine particles.

18. A photoconductor cartridge incorporating a photoconductor coated with a surface protection layer comprising a cured material of a fluorine-containing photo-curing composition containing fluorinated alkyl group-containing (meth) acrylate and a photopolymerization initiator, the surface protection layer having a fluorine atom content of 8.5 to 20% by mass.

19. An image-forming apparatus incorporating a photoconductor coated with a surface protection layer comprising a cured material of a fluorine-containing photo-curing composition containing fluorinated alkyl group-containing (meth)acrylate and a photopolymerization initiator, the surface protection layer having a fluorine atom content of 8.5 to 20% by mass, and further incorporating developing means for developing electrostatic latent images formed on the photoconductor by means of a positively chargeable liquid developing agent containing vegetable oil as a carrier liquid.

* * * * *